US007206542B2

(12) United States Patent
Terao et al.

(10) Patent No.: US 7,206,542 B2
(45) Date of Patent: Apr. 17, 2007

(54) SHEET POST-PROCESS APPARATUS AND WAITING TRAY

(75) Inventors: Yasunobu Terao, Tagata-gun (JP); Yoshiaki Sugizaki, Sunto-gun (JP); Tomomi Iijima, Mishima (JP); Tokihiko Ise, Tagata-gun (JP); Hiroyuki Taki, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 78 days.

(21) Appl. No.: 11/008,145

(22) Filed: Dec. 10, 2004

(65) Prior Publication Data

US 2006/0067764 A1 Mar. 30, 2006

(30) Foreign Application Priority Data

Sep. 28, 2004 (JP) ..... 2004-281778

(51) Int. Cl.
*G03G 15/00* (2006.01)

(52) U.S. Cl. ..... 399/405; 399/397

(58) Field of Classification Search ..... 399/405, 399/407, 408, 410; 270/58.07–58.09
See application file for complete search history.

(56) References Cited

U.S. PATENT DOCUMENTS 4,473,425 A 9/1984 Baughman et al.
4,611,741 A 9/1986 Wilson
4,794,859 A * 1/1989 Huseby et al. ..... 101/485
4,849,796 A 7/1989 Murakami
4,898,374 A 2/1990 Vermaat
5,021,837 A 6/1991 Uto et al.
5,098,074 A 3/1992 Mandel et al.
5,282,611 A 2/1994 Ueda et al.
5,285,249 A 2/1994 Mahoney (Continued)

FOREIGN PATENT DOCUMENTS

JP 62-008965 A 1/1987

(Continued)

OTHER PUBLICATIONS

U.S. Appl. No. 11/008,122, filed Dec. 10, 2004, Sasahara.

(Continued)

*Primary Examiner*—Anthony H. Nguyen
(74) *Attorney, Agent, or Firm*—Foley & Lardner LLP

(57) ABSTRACT

A waiting tray comprises left and right lower face support members for supporting a sheet. These support members are formed so that a width of an opening portion formed therebetween is wide at a distal end side as compared with a proximal end side in a transport direction of a sheet to be transported to the waiting tray. When the sheet which is not required to be retained in a waiting mode is transported to the waiting tray, at a time point when the sheet distal end reaches the waiting tray, both of the support members are opened to an extent such that the width of the opening portion of the left and right lower face support members is narrower than a sheet width at the proximal end side in the transport direction of the sheet, and is wider than the sheet width at the distal end side of the sheet. In this manner the sheet is dropped from the sheet distal end to the processing tray immediately without being retained in a waiting mode.

20 Claims, 18 Drawing Sheets

U.S. PATENT DOCUMENTS 5,289,251 A * 2/1994 Mandel et al. ..... 399/407
5,435,544 A 7/1995 Mandel
5,451,037 A 9/1995 Lundstrom
5,590,871 A 1/1997 Okabe et al.
5,628,502 A 5/1997 Amarakoon
5,676,517 A 10/1997 Lotz
5,709,376 A 1/1998 Ushirogata
5,934,140 A 8/1999 Jackson et al.
5,961,274 A 10/1999 Bors
5,971,384 A * 10/1999 Asao ..... 270/58.13
6,065,747 A 5/2000 Khovaylo et al.
6,092,948 A 7/2000 Altfather
6,142,461 A 11/2000 Asao et al.
6,179,287 B1 1/2001 Watanabe et al.
6,231,039 B1 5/2001 Chung
6,330,999 B2 * 12/2001 Coombs et al. ..... 270/58.18
6,336,630 B1 1/2002 Holtman et al.
6,354,059 B1 3/2002 Yoshie et al.
6,357,753 B1 3/2002 Yamasaki et al.
6,450,934 B1 9/2002 Coombs
6,581,922 B2 6/2003 Kuwata et al.
6,641,129 B2 11/2003 Ogita et al.
6,659,455 B2 12/2003 Endo et al.
6,671,492 B2 12/2003 Mimura et al.
6,698,744 B2 3/2004 Yamada et al.
6,712,349 B2 3/2004 Watanabe
6,722,646 B2 * 4/2004 Sekiyama et al. ..... 270/58.09
6,722,650 B1 4/2004 Abbata et al.
6,733,006 B2 5/2004 Kobayashi et al.
6,733,007 B2 5/2004 Sekiyama et al.
6,767,012 B2 7/2004 Sasamoto
6,819,906 B1 11/2004 Herrmann et al.
6,824,128 B2 * 11/2004 Nagata et al. ..... 270/58.08
6,871,042 B2 3/2005 Nemura et al.
6,910,686 B2 6/2005 Awano
6,928,259 B2 8/2005 Sakuma
6,988,728 B2 1/2006 Kida
2002/0047233 A1 4/2002 Coombs et al.
2002/0053766 A1 5/2002 Kubota
2002/0163119 A1 11/2002 Kawata
2003/0057625 A1 3/2003 Kuwata et al.
2004/0113348 A1 6/2004 Awano
2004/0126163 A1 * 7/2004 Asami et al. ..... 399/410
2004/0181308 A1 9/2004 Hayashi et al.
2005/0000336 A1 1/2005 Hattori et al.

FOREIGN PATENT DOCUMENTS

JP 04-312894 A 11/1992
JP 2583594 B2 11/1996
JP 2001-089009 A 4/2001
JP 2003-081517 A 3/2003
JP 2004-142863 A 5/2004

OTHER PUBLICATIONS

U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.

* cited by examiner

SHEET POST-PROCESS APPARATUS AND WAITING TRAY

CROSS-REFERENCE TO RELATED APPLICATIONS

This application is based upon and claims the benefit of priority from prior Japanese Patent Application No. 2004-281778, filed Sep. 28, 2004, the entire contents of which are incorporated herein by reference.

BACKGROUND OF THE INVENTION

1. Field of the Invention

The present invention relates to an apparatus (finisher) for bundling sheets sent from an image forming apparatus, thereby carrying out, for example, staple processing and a waiting tray for use in the post-process apparatus.

2. Description of the Related Art

A post-process apparatus comprises: a processing tray for bundling sheets sent from an image forming apparatus, thereby carrying out, for example, staple processing, and ejecting the processed bundles of sheets; and a storage tray for holding the ejected bundles of sheets. A staple processing speed of the post-process apparatus is slow as compared with an image processing speed of the image forming apparatus. Thus, if a sheet is directly sent to the processing tray, a sheet to be staple processed next is transported while a preceding sheet is staple processed. In order to prevent this problem, conventionally, a buffer mechanism for adjusting a carrying-in timing of a sheet at a front stage of the processing tray is proposed.

Japanese Patent Document 1: Japanese Patent No. 2583594 discloses a mechanism for retaining sheets is provided at a transport passage for sending sheets sent from an image forming apparatus to a processing tray. However, in this case, there is a need for increasing the transport passage in length, and, as a result, the post-process apparatus is likely to be large in size.

Japanese Patent document 2: Jpn. Pat. Appln. KOKAI Publication No. 2004-142863 discloses a width guide being narrowly formed at the upstream side in a sheet transport direction of a support face for supporting a sheet bottom face so that a bundle of sheets first comes into contact with a storage tray from the upstream side in the transport direction. However, this width guide is provided to systematically eject a plurality of bundles of sheets on the storage tray. In addition, this width guide is provided to easily distinguish the distinction between the bundles of sheets. The sheets are always dropped via processing on the width guide. That is, the width tray of patent document 2 is not provided to immediately drop the sheets transported on the waiting tray onto the processing tray. Therefore, the invention of Patent document 2 is technically different from the present invention, and advantageous effect of the present invention cannot be attained.

BRIEF SUMMARY OF THE INVENTION

The Inventors proposes here that a waiting tray is newly allocated as a buffer mechanism at an upper stage of a processing tray. The waiting tray according to this proposal is allocated to be proximal to the upper stage of the processing tray, and a sheet transported from an image forming apparatus to the processing tray is temporarily retained here in a waiting mode. At a time point when retention in a waiting mode is released, that is, at a time point when staple processing of a bundle of sheets at the processing tray terminates, and then, the bundle of sheets is transported from the processing tray to a storage tray, the sheet is supported on a bottom face of the waiting tray. By opening this tray, the sheet is then dropped at the distal end side (upstream side when the sheet is transported to the waiting tray) to the processing tray. By using this waiting tray, equipment can be allocated with a simple mechanism without a need to increase a transport passage in length and providing a space. As a result, a post-process apparatus can be made compact. Moreover, it is possible to sent the sheets to the processing tray without any malfunction.

In the case where this waiting tray is applied, when a preceding sheet is staple processed, it is necessary to retain a next sheet on the waiting tray in a waiting mode. When staple processing of a preceding sheet terminates, the sheet is transported to the storage tray, and the processing tray is empty, the subsequent sheets are not required to be made standby on the waiting tray. Such a sheet is required to be speedily transported to the processing tray.

However, when the sheet is directly dropped on the processing tray without being retained in the waiting tray in a waiting mode while the waiting tray is opened, the sheet is transported to a sheet proximal end side (downstream side). Thus, it is difficult for the sheet to drop from a sheet distal end, and there is the possibility that drop of sheets is unstable. On the other hand, after a sheet is held on the waiting tray, when the sheet is dropped by opening the waiting tray, the sheet can be dropped from the sheet distal end side, thereby dropping the sheet stably. However, it is impossible to attain the object of dropping speedily the sheet.

The present invention has been proposed so that this waiting tray functions efficiently. It is an object of the present invention to provide a sheet post-process apparatus and a waiting tray in which, a sheet not requiring standby on a waiting tray is dropped speedily and stably from a sheet distal end, and improving alignment property of the sheet distal end on the processing tray.

In order to solve the above described problem, the present invention comprises the following features.

1. A sheet post-process apparatus, the apparatus comprising:

a waiting tray which temporarily retains a transported sheet in a waiting mode, and releases the retention to drop the sheet;

a processing tray which bundles sheets dropped from the waiting tray to carry out predetermined processing, and ejects the sheets; and a storage tray which holds the bundle of sheets processed and ejected on the processing tray, wherein the waiting tray comprises:

left and right lower face support members which support left and right lower faces in a sheet transport direction during retention in a waiting mode and release the support of the left and right lower faces during release of the retention, a width of an opening portion formed between both of the members being widely formed at a distal end side compared with a proximal end side in a transport direction of a sheet transported to the waiting tray;

drive means for opening the left and right lower face support members to widen the width of the opening portion;

sensor means for sensing the sheet transported to the waiting tray; and control means for driving the driver device based on the sense signal of the sensor means, and the control means controls the drive means so that both of the support members are opened to an extent such that the width of the opening portion is narrower than the sheet width at the proximal end side in the transport direction of the sheet and is wider than the sheet width at the distal end side thereof and so that the sheet is dropped from the sheet distal end to the processing tray without being retained in a waiting mode.

2. A sheet post-process apparatus according to 1, wherein the control means controls the drive means upon the receipt of a signal indicating that the sheet to be transported to the waiting tray is a sheet which is not required to be retained in a waiting mode.

3. A sheet post-process apparatus according to 1, wherein the waiting tray is allocated to be proximal to an upper stage of the processing tray, the processing tray and the waiting tray are allocated in an inclined shape which is high at a proximal end side of a sheet to be transported and which is low at a distal end side thereof, the processing tray and the waiting tray are shorter in length of a sheet transport direction thereof than a length of a standard sheet to be held, and a part of the proximal end side in the transport direction of the sheet held on the processing tray is held on the storage tray.

4. A waiting tray for use in a sheet post-process apparatus, for temporarily retaining a transported sheet in a waiting mode and releasing the support, making it possible to drop the sheet on a processing tray, the waiting tray comprising:

left and right lower face support members which support left and right lower faces in a sheet transport direction during retention in a waiting mode and release the support of the left and right lower faces during release of the retention, a width of an opening portion formed between both of the members being widely formed at a distal end side compared with a proximal end side in a transport direction of a sheet transported to the waiting tray;

drive means for opening the left and right lower face support members to widen the width of the opening portion;

sensor means for sensing the sheet transported to the waiting tray; and control means for driving the driver device based on the sense signal of the sensor means, and the control means controls the drive means so that both of the support members are opened to an extent such that the width of the opening portion is narrower than the sheet width at the proximal end side in the transport direction of the sheet and is wider than the sheet width at the distal end side thereof and so that the sheet is dropped from the sheet distal end to the processing tray without being retained in a waiting mode.

5. A waiting tray according to 4, wherein the left and right lower face support members are slidable in a widthwise direction of a sheet to be transported.

6. A sheet post-process apparatus, the apparatus comprising:

waiting means for temporarily retaining a transported sheet in a waiting mode, and releasing the retention to drop the sheet;

processing means for bundling sheets dropped from the waiting means to carry out predetermined processing, and ejecting the sheets; and storage means for holding the bundle of sheets processed and ejected on the processing means, wherein the waiting means comprises:

left and right lower face support means for supporting left and right lower faces in a sheet transport direction during retention in a waiting mode and releasing the support of the left and right lower faces during release of the retention, a width of an opening portion formed between both of the means being widely formed at a distal end side compared with a proximal end side in a transport direction of a sheet transported to the waiting means;

drive means for opening the left and right lower face support means to widen the width of the opening portion;

sensor means for sensing the sheet transported to the waiting means; and control means for driving the driver device based on the sense signal of the sensor means, and the control means controls the drive means so that both of the support members are opened to an extent such that the width of the opening portion is narrower than the sheet width at the proximal end side in the transport direction of the sheet and is wider than the sheet width at the distal end side thereof and so that the sheet is dropped from the sheet distal end to the processing tray without being retained in a waiting mode.

In the present specification and claims, a proximal end side, a distal end side, and a sheet width are defined as follows. That is, when a transport direction of a sheet to be transported to a waiting tray is defined as a reference, a downstream side in the transport direction is defined as a proximal end side; an upstream side in the transport direction is defined as a distal end side; and a length in a transverse direction when the sheet transport direction is defined as a longitudinal direction is defined as a sheet width. In addition, a sheet denotes a copy sheet on which a toner image (developed image) is copied and which is sent from the image forming apparatus.

According to the waiting tray of the present invention, in the case where a sheet which is not required to be retained on the waiting tray in a waiting mode has been transported to the waiting tray, the sheet can be dropped onto the processing tray by opening the left and right lower face support members at the same time when a sheet distal end portion reaches the waiting tray, and a processing speed can be increased. Further, in a state of a sheet immediately before dropped, although the distal end side of the sheet is not supported by the left and right lower face support members, a proximal end side of the sheet is supported by the left and right lower face support member. Therefore, the sheet is first dropped from the distal end side on the processing tray when the left and right lower face support members are opened. The sheet is dropped from the distal end side, wherein the sheet can be stably dropped with good posture, and alignment processing of the sheet distal end on the processing tray can be easily carried out.

Moreover, the waiting tray is allocated to be inclined lowly at the distal end side. This allocation helps the sheet being reliably dropped from the distal end portion.

BRIEF DESCRIPTION OF THE SEVERAL VIEWS OF THE DRAWING

FIGS. 21A and 21B are views each illustrating a description of operation of the waiting tray showing one embodiment of the present invention, the views each showing a state indicating that a sheet is to be transported to the waiting tray, wherein FIG. 21A is a schematic top view, and FIG. 21B is a schematic side view;

FIGS. 22A and 22B are views each illustrating a description of operation of the waiting tray showing one embodiment of the present invention, the views each showing a state indicating that a sheet is being transported to the waiting tray, wherein FIG. 22A is a schematic top view, and FIG. 22B is a schematic side view;

FIGS. 23A and 23B are views each illustrating a description of operation of the waiting tray showing one embodiment of the present invention, the views each showing a state indicating that a sheet being transported to the waiting tray, wherein FIG. 23A is a schematic top view, and FIG. 23B is a schematic side view; and FIGS. 24A and 24B are views each illustrating a description of operation of the waiting tray showing one embodiment of the present invention, the views each showing a state indicating that a sheet has reached the waiting tray, wherein FIG. 24A is a schematic top view, and FIG. 24B is a schematic side view.

DETAILED DESCRIPTION OF THE INVENTION

Now, one embodiment of the present invention will be described here.

(General Description of Image Forming Apparatus)

Figure 18:
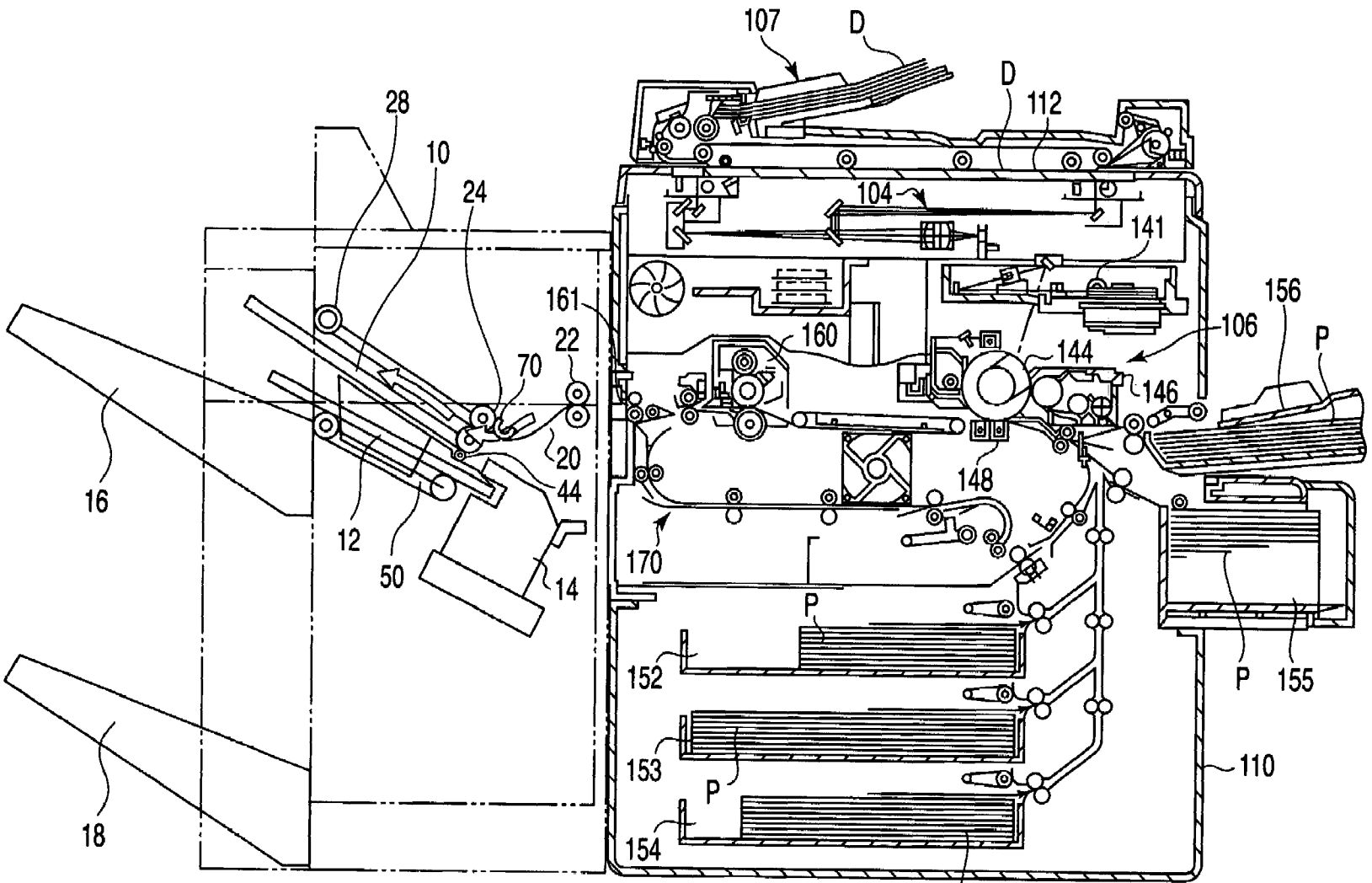
FIG. 18 is a view showing a combination of the post-process apparatus and the image forming apparatus according to the present invention.

A general description of an image forming apparatus (digital copying machine) allocated at a front stage of a post-process apparatus according to the present invention will be given with reference to FIG. 18. A manuscript placement base 112 is provided at an upper face of this apparatus. An auto document feeder 117 (hereinafter, referred to as an ADF) for automatically feeding a document D onto the manuscript placement base 112 is allocated on the manuscript placement base. The manuscript D is placed on the ADF, predetermined settings (such as the presence of absence of staple processing, how to carry out staple processing, the number of copies, or size of sheet to be copied, for example), and then, a copy start button is pressed. The manuscript D on the ADF is transported to a predetermined location of the manuscript placement base 112.

A scanner unit 4, a printer unit 6, and a copy sheet cassette and feeder are arranged at the inside of the image forming apparatus. At the scanner unit 4, the manuscript D on the manuscript placement base 112 is scanned, and reflection light thereof is incident. The incident reflection light is converted in a photo-electric manner, image information on the manuscript D is read, and a photoelectric signal corresponding to the read image information is output. At the printer unit 6, according to the image information or the like on the manuscript D read by the scanner unit 4, an electrostatic latent image is formed on a peripheral face of a photosensitive drum 144 by a semiconductor laser 141. Then, a toner is supplied from a developing device 146 to the photosensitive drum 144; the electrostatic latent image formed on the photosensitive drum 144 is substantially produced, and a tone image is formed.

To this photosensitive drum 144, a copy sheet P is sent from cassettes 52, 53, 54, and 56 or a feeder 55 of the copy sheet P, and the toner image on the photosensitive drum 144 is copied onto the copy sheet by a transfer charger 148. Then, the toner image of the copy sheet is fixed by a fixing device 160, and the fixed toner image is ejected from an ejection port 161. This sheet comes under the sheet of the present specification and claims.

In a control circuit of the image forming apparatus side, information concerning a sheet such as sheet size, the presence or absence of sort, or the presence or absence of staple processing is entered by operator's data input and/or an input signal from sensor means provided in the image forming apparatus. The control circuit at the image forming apparatus side sends information concerning a sheet transported to the control circuit of the post-process apparatus side based on these items of information. The information includes the following. For example, the sheet is provided as a sheet retained in the waiting tray in a waiting mode, the sheet being a sheet other than a last sheet to be held. The sheet is provided as a sheet retained in the standby sheet in a waiting mode, the sheet being a last sheet to be held. The sheet is provided as a sheet retained in the waiting tray in a waiting mode (a sheet being directly dropped on the processing sheet). The sheet is provided as a sheet being directly ejected to the storage tray without being dropped on the waiting tray. Information concerning dimensions of a sheet to be transported to the post-process apparatus (such as A3 or A4 size, for example) or sheet length (such as ordinary paper or a variety of cardboards, for example) is also sent from a control circuit at the image forming apparatus side to a control circuit at the post-process apparatus side.

Information concerning a length of a sheet which is larger than that of a set sheet is sensed by a sensor provided in the post-process apparatus. The sensed information is sent from this sensor to the control circuit at the post-process apparatus side.

(General Description of Post-Process Apparatus)

A general description of the post-process apparatus will be given with reference to FIG. 18. The post-process apparatus is provided as an apparatus for bundling sheets 20 transported from an image forming apparatus, thereby carrying out staple processing or the like. This post-process apparatus is allocated in contact with the ejection port 161 of the image forming apparatus. That is, a sheet transport inlet is provided in association with the ejection port 161 of the image forming apparatus, and an inlet roller 22 is allocated in this sheet transport inlet. The inlet roller 22 introduces the sheets 20 into a paper pass ceiling 36 for forming a transport passage in the post-process apparatus (refer to FIG. 1). This paper pass ceiling 36 guides a sheet to a waiting tray 10 and a processing tray 12. Two storage trays 16 and 18 are allocated at the downstream side of the processing tray 12 (at the downstream side of the waiting tray 10).

The waiting tray 10 is allocated to be proximal to the upper stage of the processing tray 12 while the waiting tray is inclined so as to be upward at the proximal end side of the sheet to be transported and so as to be downward at the distal end side. A paper feed roller 24 is provided at the distal end side of this waiting tray 10 (at the upstream side of the sheet to be transported), and a waiting tray roller 28 is provided at the proximal end side of the tray (at the downstream side of the sheet to be transported). A sheet sensor 70 is provided at the transport inlet of the paper feed roller 24. This sensor senses a proximal end and a distal end of the sheet to be transported.

The processing tray 12 is allocated at the lower stage of the processing tray 12 while the processing tray is inclined so as to be upward at the proximal end side of the sheet (at the downward side of the sheet to be transported to the storage tray) and so as to be downward at the distal end side (upstream side of the sheet to be transported to the ejected paper storage tray). A stapler 14 is provided at the distal end side of the processing tray 12. A transport mechanism 50 is provided on the processing tray 12 so as to transport a bundle of staple processed sheets or the like to the storage tray 16 or 18.

Here, in the post-process apparatus according to the present invention, the waiting tray 10 and the processing try 12 both are small in size, as compared with the size of sheet to be transported in order to make equipment compact. Since the waiting tray 12 is small in size than a sheet to be held thereon, when a sheet is dropped from the waiting tray 10 to the processing tray 12, that sheet is held across the processing tray 12 and the storage tray 16 (or 18) (refer to FIGS. 10 to 13).

A control circuit of the post-process apparatus controls the waiting tray 10 to make a proper operation based on information concerning a sheet obtained from the control circuit at the image forming apparatus side and information available from the sheet sensor 70.

For example, when a sheet transported to the waiting tray is provided as a sheet which should be retained on the waiting tray in a waiting mode, the sheet being a sheet other than a last sheet to be held, this sheet is kept to be held in a proper location of the waiting tray.

When the above sheet is provided as a sheet to be retained on the standby sheet in a waiting mode, the sheet being a last sheet to be held, that sheet is aligned in a proper location, and is dropped on the processing tray together with the sheet which has been held in advance on the waiting tray.

When the sheet is provided as a sheet which is not required to be retained on the waiting tray in a waiting mode, that sheet is directly dropped on the processing tray.

When the sheet is provided as a sheet to be directly ejected on the storage tray without being dropped on the processing tray, that sheet is directly transported from the waiting tray to the storage tray without intervening the processing tray.

When the sheet is provided as a sheet which is larger than a set sheet (for example, a sheet of A3 in size), the waiting tray is increased in length by expanding it.

<Waiting Tray>

Figure 1:
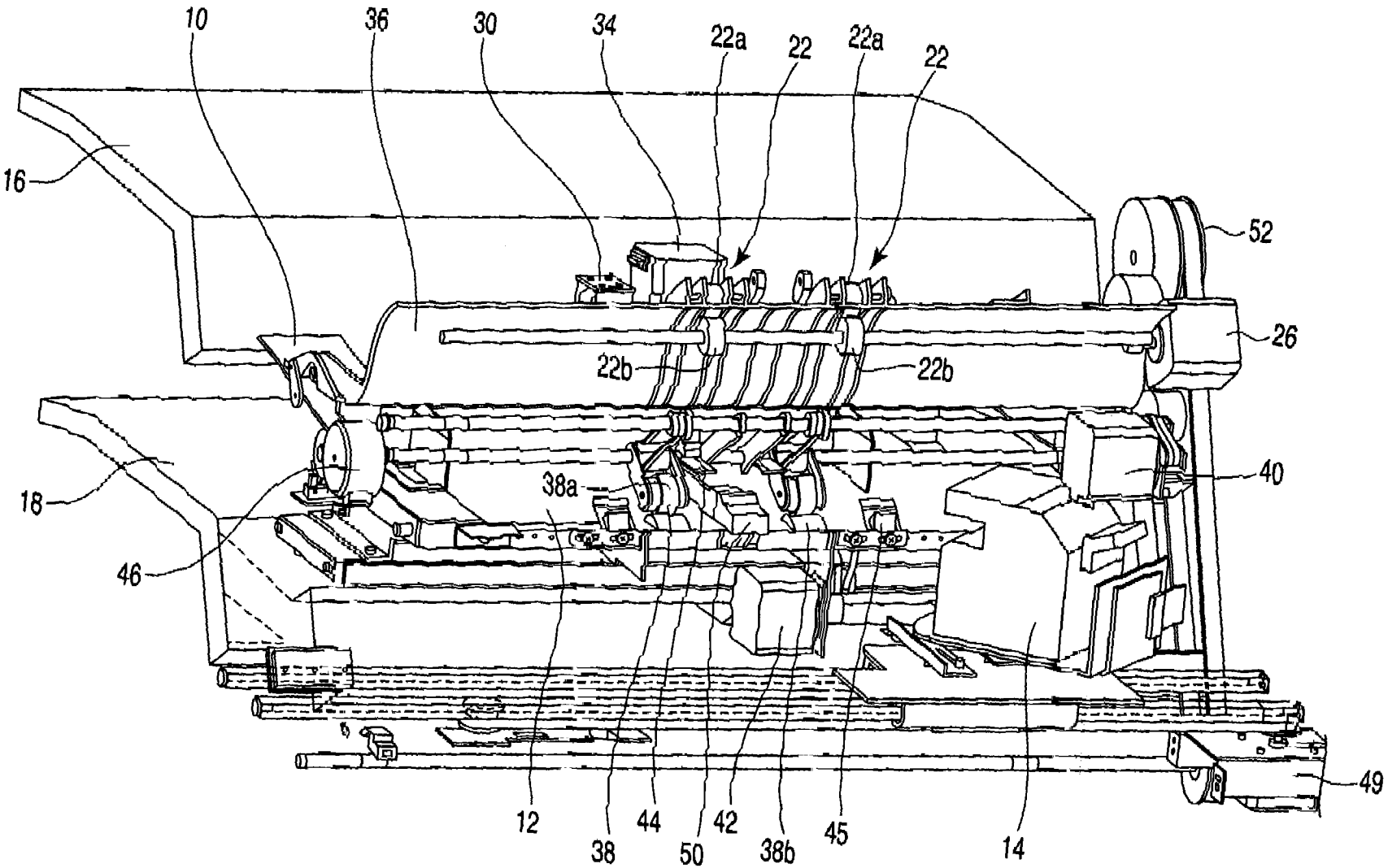
FIG. 1 is a perspective view of a post-process apparatus showing one embodiment of the present invention.
Figure 2:
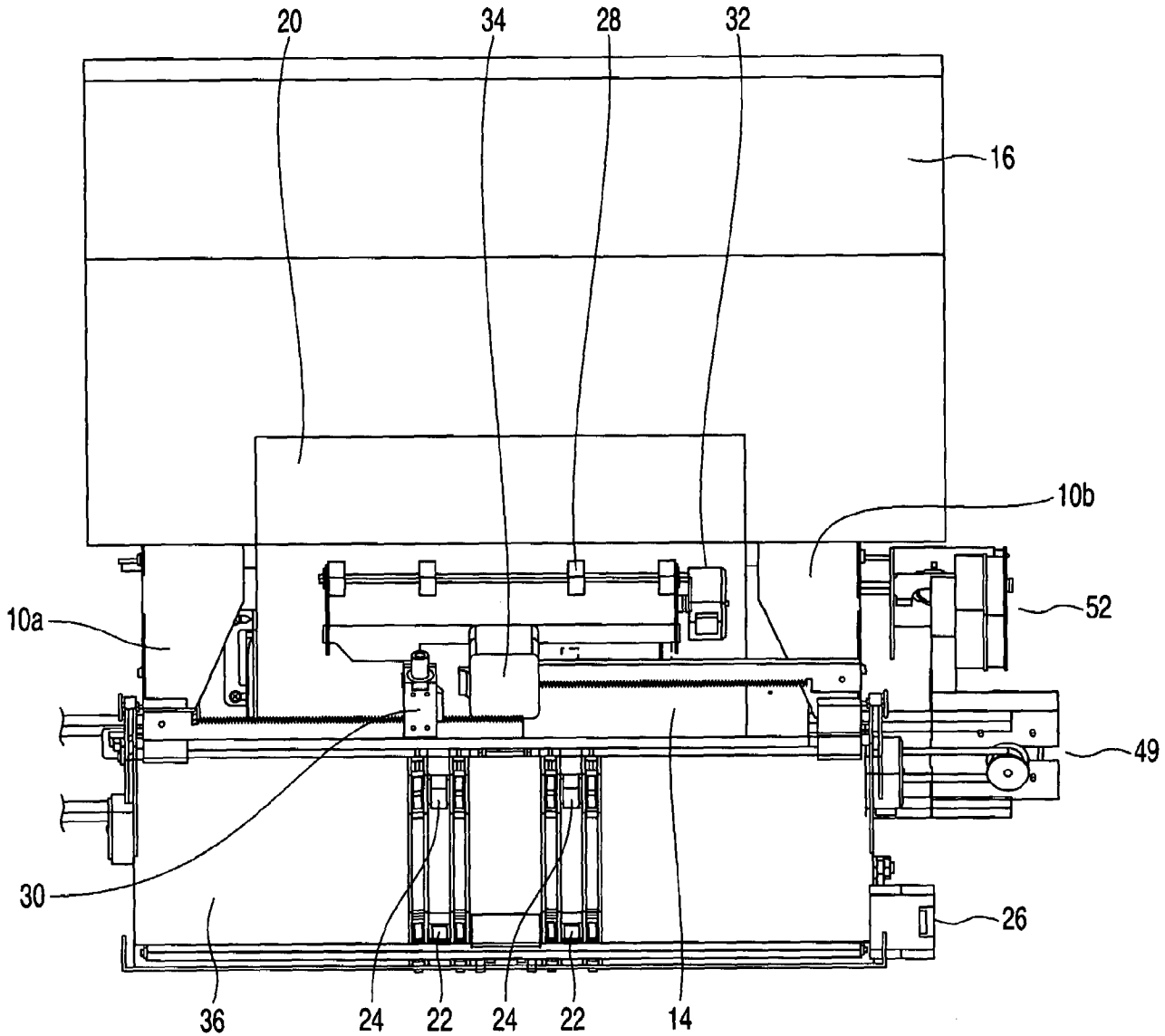
FIG. 2 is a top view of the post-process apparatus showing one embodiment of the invention.
Figure 3:
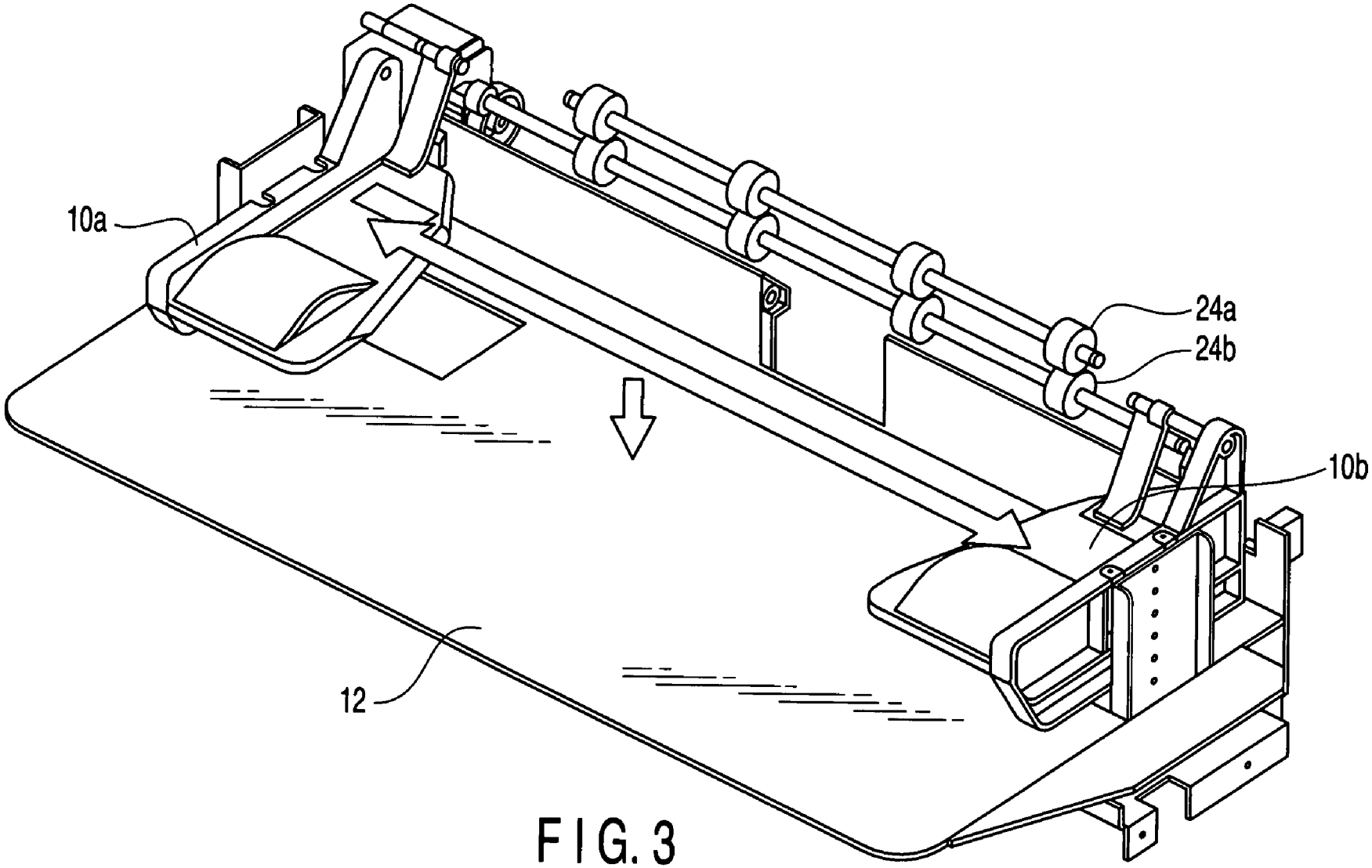
FIG. 3 is a view illustrating an operation of a waiting tray showing one embodiment of the invention.

The waiting tray will be described with reference to FIGS. 1, 2 and 3. As has been already described, when a preceding sheet is processed on the processing tray, a next sheet cannot be transported on the processing tray. The waiting tray is intended for make the next sheet standby in this state. The inlet roller 22 includes an upper inlet roller 22*a* and a lower inlet roller 22*b*. These rollers are driven by an inlet roller motor 26. The paper feed roller 24 includes an upper paper feed roller 24*a* and a lower paper feed roller 24*b*. These rollers are driven by a paper feed roller motor. The waiting tray roller 28 can be operated to be vertically elevated. This operation is controlled by a waiting tray roller drive source 30. The waiting tray roller 28 enables normal and invert rotation. This normal and invert rotation is carried out by a waiting tray roller motor 32.

On the waiting tray 10, left and right lower face support members 10*a* and 10*b* for supporting both sides of the lower face of a sheet carried into the waiting tray are provided in the left and right widthwise direction. A space between the left and right lower face support members is open. Therefore, a center section of the sheet lower face is not supported. The upper faces of these left and right lower face support members 10*a* and 10*b* each are formed in a flat shape, and a curved face which is upwardly curved is formed at its top end side. Instead of this curved face or together with the curved face, a roller which is rotatable in an arbitrary direction may be engaged. The left and right lower face support members 10*a* and 10*b* are formed in the same width from the proximal end side to the distal end side. The width used here denotes a transverse direction in the case where the sheet transport direction is defined as a longitudinal direction. The left and right lower face support members 10*a* and 10*b* can be positioned at first to third positions which are different in width of the opening portion from one another. The first position is a location in which a sheet side face can be supported fully on the left and right lower face support members. The second position is a location in which these support members are opened to an extent such that a proximal end side of the sheet is supported on the left and right lower face support members while a distal end side of the sheet is not supported on the left and right lower face support members. The third position is a location in which all the supports of the sheet is released. The left and right lower face support members 10*a* and 10*b* are driven by a waiting tray motor 34. By this waiting tray motor 34, the left and right lower face support members 10*a* and 10*b* are moved to any of the first to third positions.

The waiting tray roller 28 returns the sheet transported to the waiting tray to the distal end side, and aligns the sheet distal end by abutting the sheet distal end against a distal end 60 of the waiting tray. In this case, although the sheets are located upwardly when they are transported to the waiting tray, the roller is lowered in the case where the sheet distal end is aligned. Then, the sheets are rotated while the sheets are compressed, and the sheets are pushed back. In addition, also in the case where the sheets are transported from the waiting tray directly to the storage tray, the waiting tray roller 28 is lowered and is rotated while the sheets are compressed, and the sheets are ejected. In this case, the rotation direction of the waiting tray roller 28 becomes inverted from that in the case where the sheets are abutted against the distal end side.

On the waiting tray, there is provided the sheet sensor 70 (refer to FIGS. 19 and 20) for sensing a sheet to be proximal to the paper feed roller 24, i.e., at a side (upstream side) at which a sheet is carried in the waiting tray. This sheet sensor 70 senses the start of transport (sheet proximal end) by the paper feed roller 24 and the end of transport (sheet distal end) by the sheer feed roller 24. This sense signal is fed to control means (refer to FIG. 19).

Figure 19:
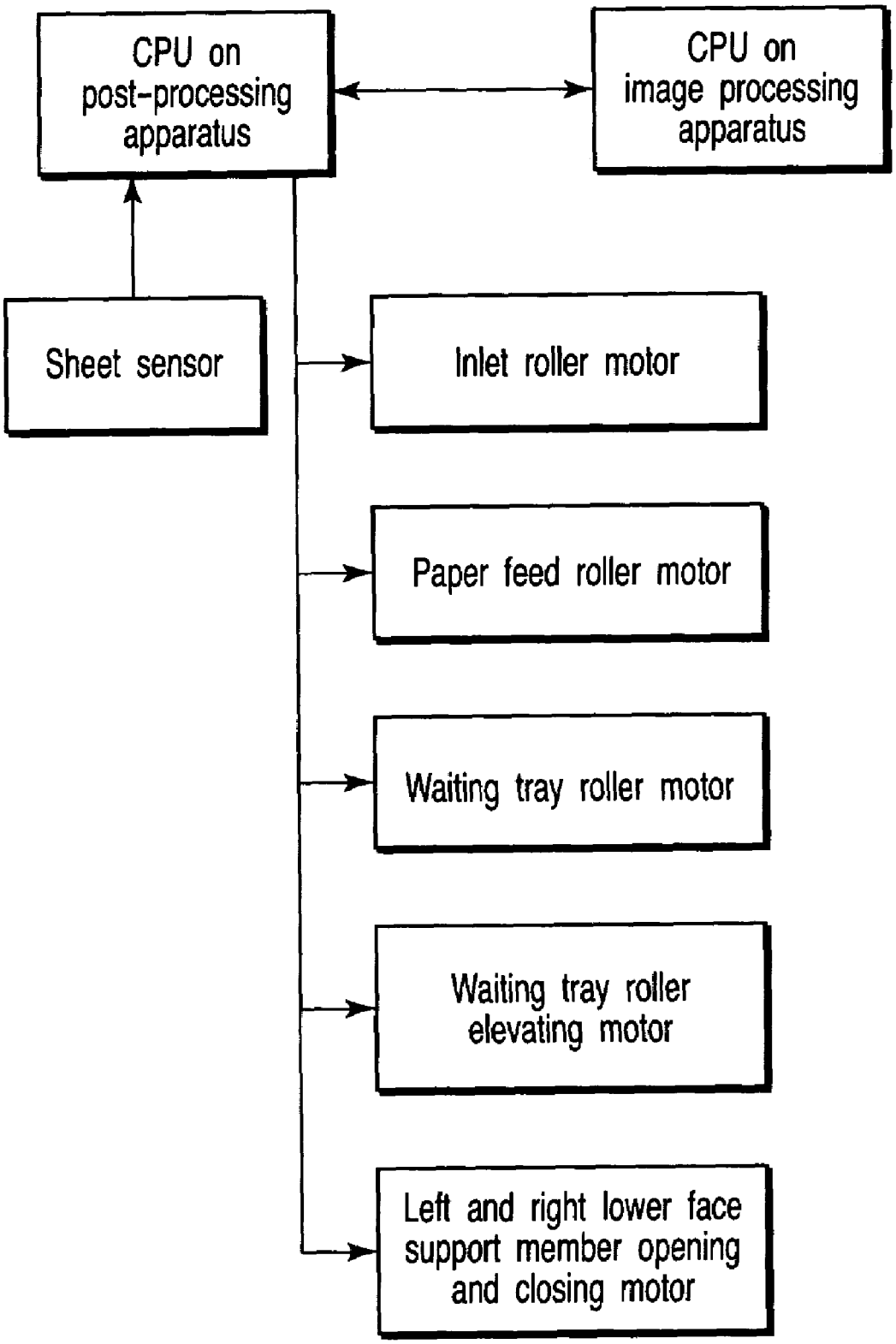
FIG. 19 is a view showing a control system of the waiting tray showing one embodiment of the present invention.
Figure 20:
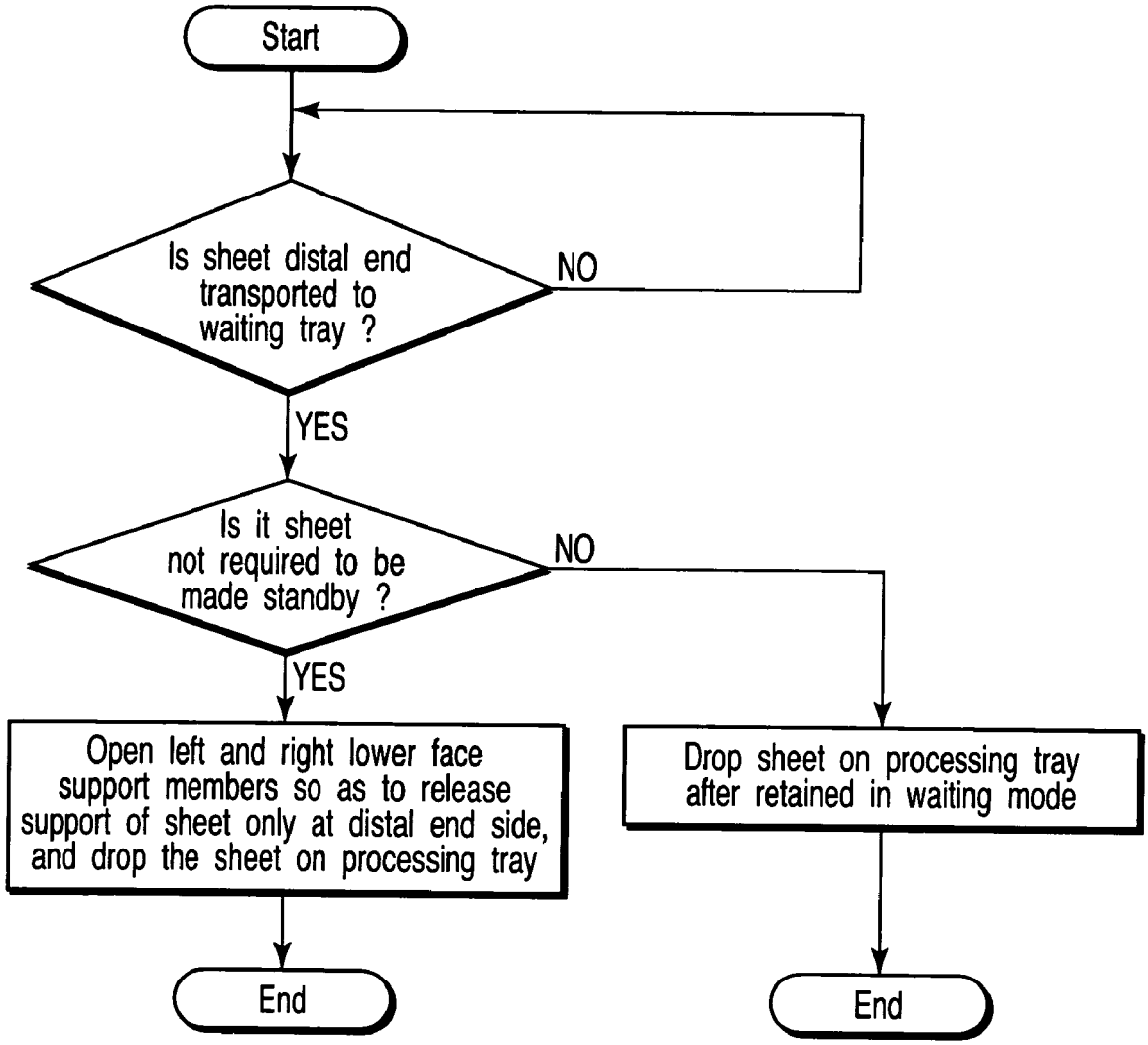
FIG. 20 is a flow chart of the waiting tray showing one embodiment of the present invention.

As shown in FIG. 19, the control means of the post-process apparatus having received information from the control means of the image processing apparatus (for example, the presence or absence of staple processing, how to carry out staple processing, the number of copies, and signal of size of sheet to be copied) senses whether the sheet to be transported to the waiting tray is provided as a sheet which should be retained on the waiting tray in a waiting mode or is provided as a sheet which is not required to be retained in a waiting mode. For example, the control means senses that the first and second sheets are provided as sheets to be retained on the waiting tray in a waiting mode and the third or subsequent sheets are provided as sheets which are not required to be retained in a waiting mode, based on information indicating how to carry out staple processing. Alternatively, the control means senses that retention in a waiting mode on the waiting tray is not required from the information indicating that no staple processing is carried out. In addition, the control means having received a signal from the sheet sensor 70 senses a state in which the sheet is carried into the waiting tray 10. Then, the control means of the post-process apparatus instructs the drive motor of the lower face support members 10*a* and 10*b* to output a control signal of a release timing or a release quantity (release width) of the left and right lower face support members 10*a* and 10*b*. Then, a sheet is properly dropped onto the processing tray 12 with a proper timing.

Specifically, in the case where a sheet transported to the waiting tray is a sheet which should be retained on the waiting tray in a waiting mode, the sheet is supported by the left and right lower face support members 10*a* and 10*b* which are set at the first position. Then, the distal end of the sheet is aligned by the waiting tray roller. Next, for example, when it is sensed that, after staple processing of a precedent sheet on the processing tray completes, the staple processed sheet has been sent from the processing tray to the storage tray, the control means supplies a sheet retention release instruction. By this instruction, the left and right lower face support members 10*a* and 10*b* are opened (located at the second position or third position). In this case, the distal end side is first released, and thus, the sheet is dropped from the distal end side to the processing tray.

On the other hand, in the case where the sheet transported to the waiting tray is a sheet which is not required to be retained on the waiting tray in a waiting mode, when the sheet distal end reaches the waiting tray, the left and right lower face support members 10*a* and 10*b* are opened to be located at the second position immediately without the sheet being retained in a waiting mode. That is, the left and right lower face support members 10*a* and 10*b* are opened to an extent such that, although the proximal end side of the sheet is supported by the left and right lower face support members 10*a* and 10*b*, the distal end side of the sheet is not supported by the left and right lower face support members 10*a* and 10*b*. As a result, the release width of the above support members is merely released only at the distal end side, and thus, the sheet is dropped from the distal end side to the processing tray in a state in which it is supported at the proximal end side.

<Processing Tray>

The processing tray carries out longitudinal and transverse alignments with respect to bundles of sheets dropped from the waiting tray and carries out predetermined processing (for example, staple processing). This processing tray is allocated in an inclined shape which is high at its proximal end side and which is low in its distal end side.

Figure 4:
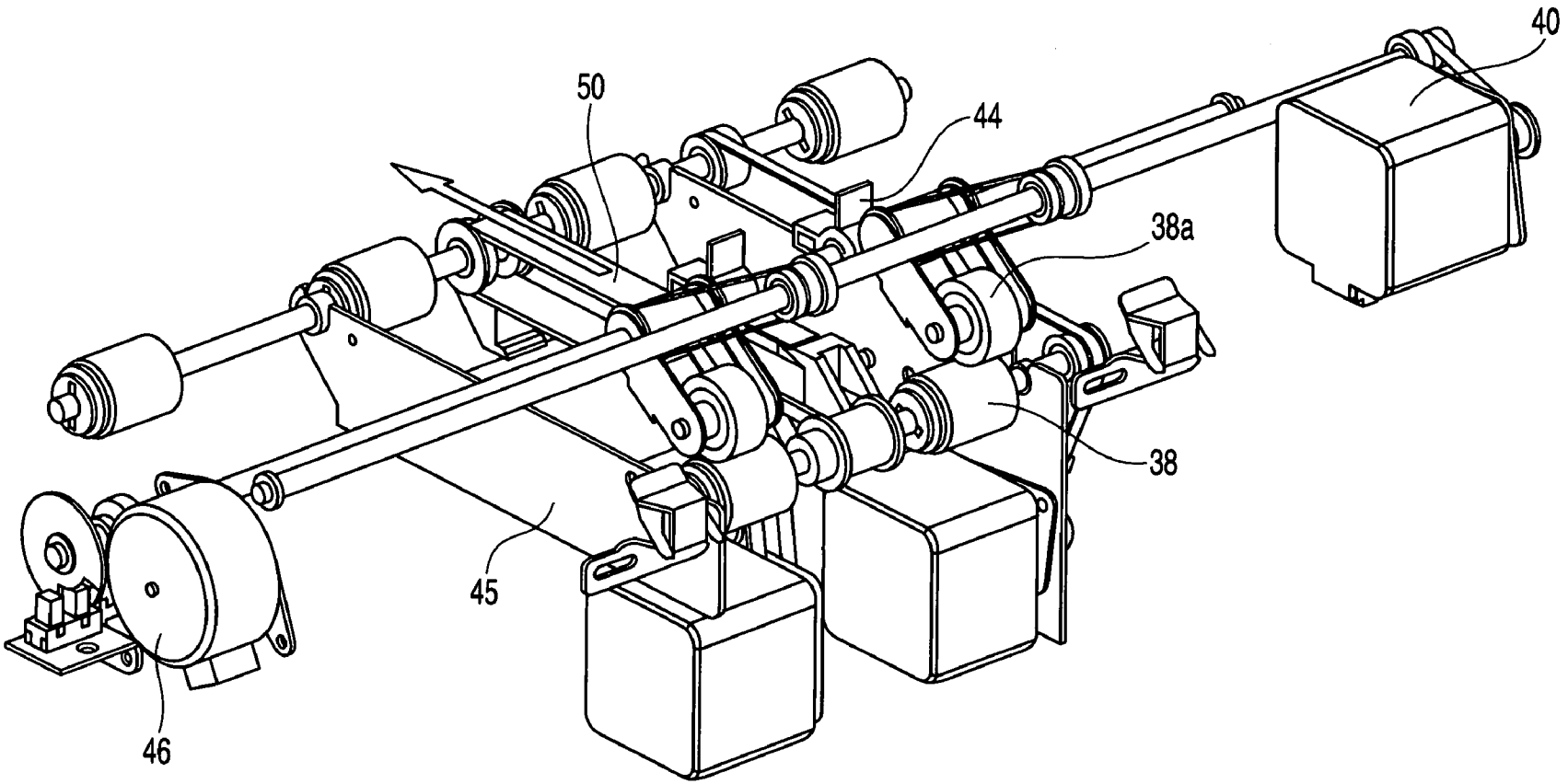
FIG. 4 is a view illustrating a longitudinal alignment and sheet bundle transport mechanism of the post-process apparatus showing one embodiment of the invention.

As shown in FIG. 4, longitudinal alignment is carried out by a longitudinal alignment roller 38. A longitudinal alignment upper roller 38*a* is driven by a longitudinal alignment upper roller motor 40, and a longitudinal alignment lower roller 38*b* is driven by a longitudinal alignment lower roller motor 42 to align sheets while a stopper 45 is defined as a reference. In addition, in order to assist this alignment, a paddle 44 is provided. This paddle 44 is driven by a paddle motor 46.

Figure 5:
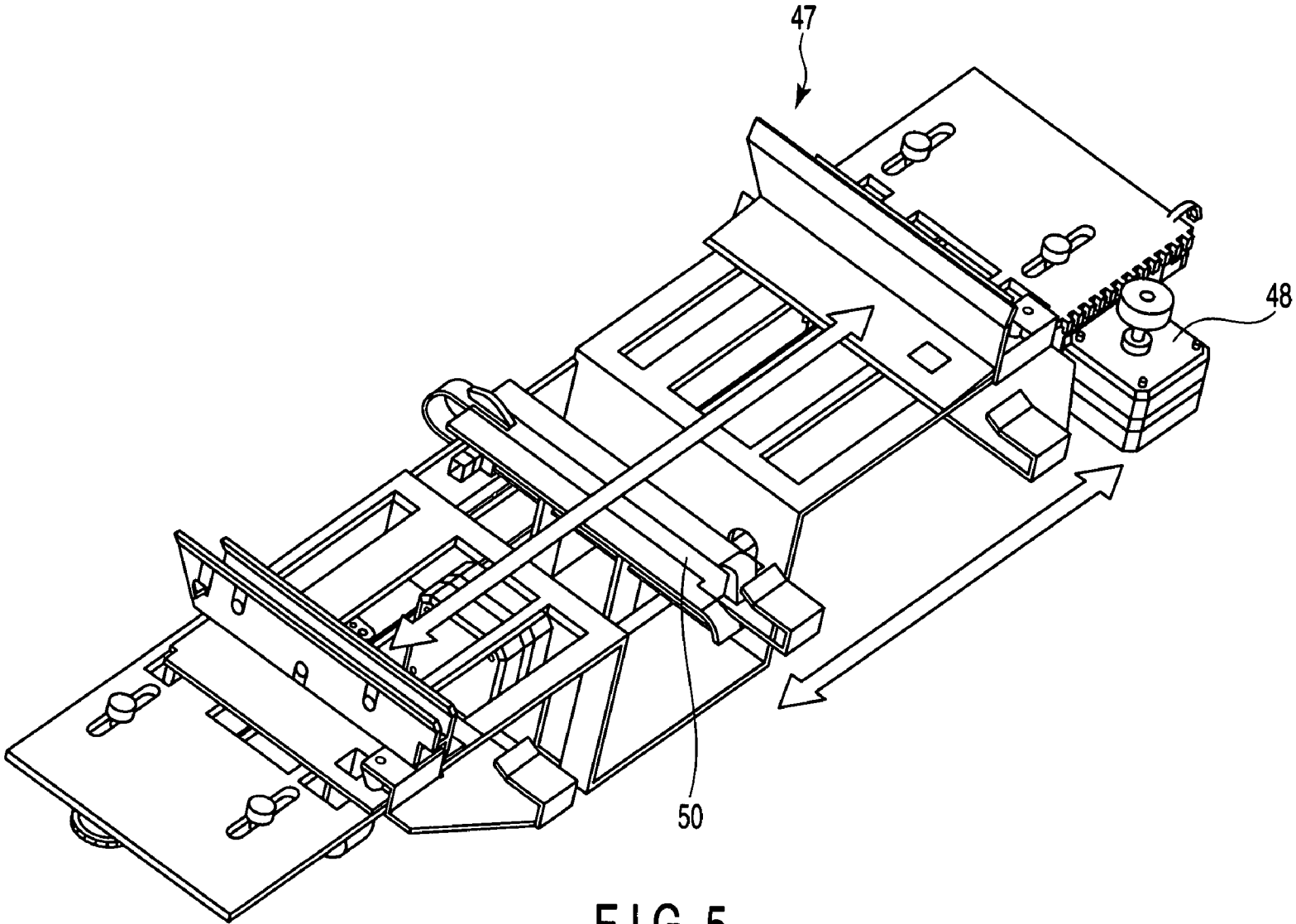
FIG. 5 is a view illustrating a transverse alignment mechanism of the post-process apparatus showing one embodiment of the invention.

As shown in FIG. 5, transverse alignment is executed by a transverse alignment mechanism 47 and a transverse alignment motor 48.

When a predetermined number of sheets are aligned and stacked on the processing tray 12, staple processing is carried out by the stapler 14.

Figure 6:
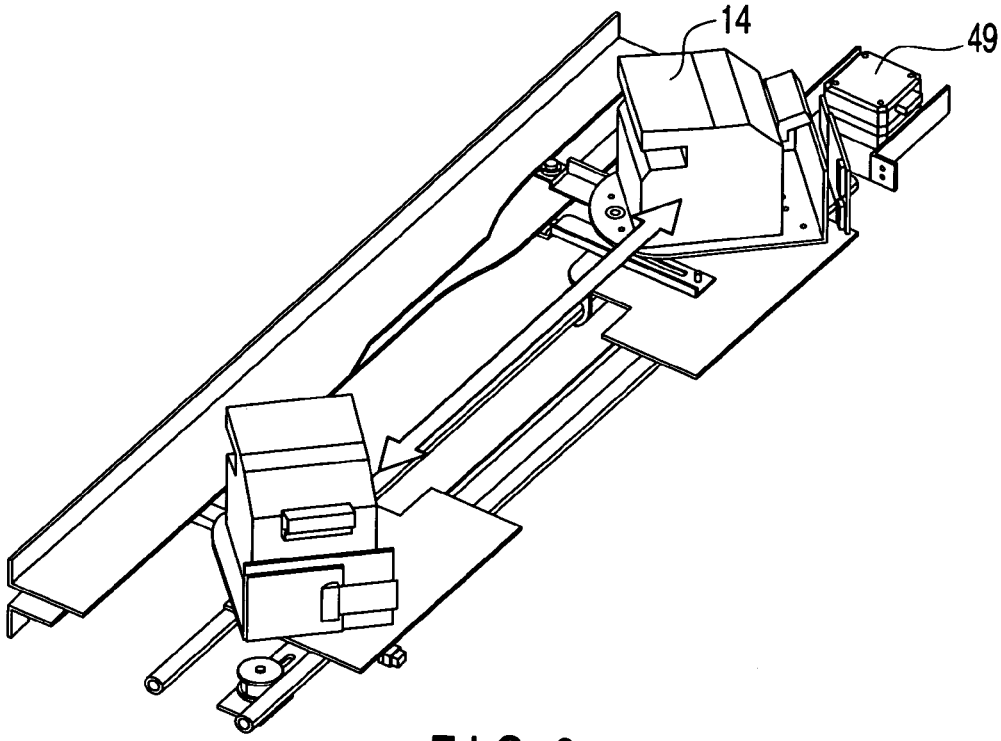
FIG. 6 is a view illustrating an operation of a stapler of the post-process apparatus showing one embodiment of the invention.
Figure 7:
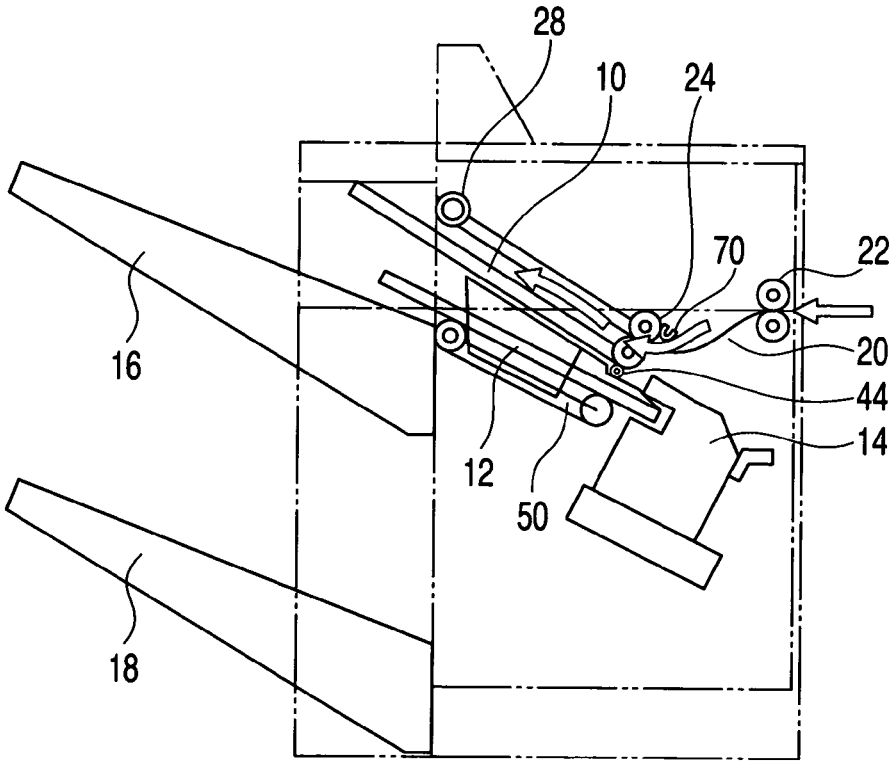
FIG. 7 is a view illustrating a flow of a first sheet of sheets between an inlet roller and a paper feed roller in the post-process apparatus showing one embodiment of the invention.
Figure 8:
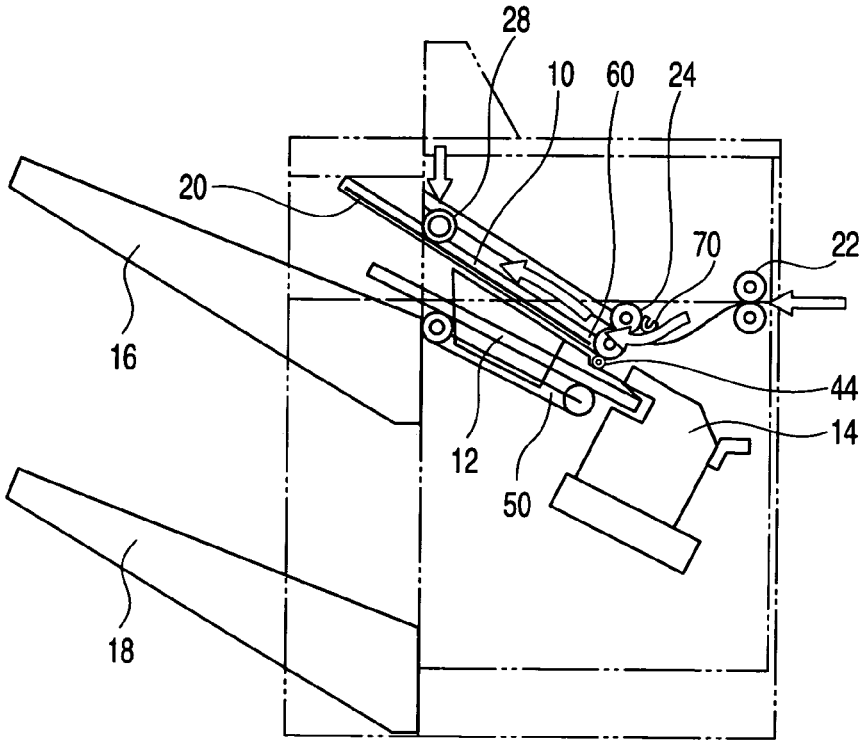
FIG. 8 is a view illustrating a flow of a first sheet of sheets between the paper feed roller and a standby roller in the post-process apparatus showing one embodiment of the invention.
Figure 9:
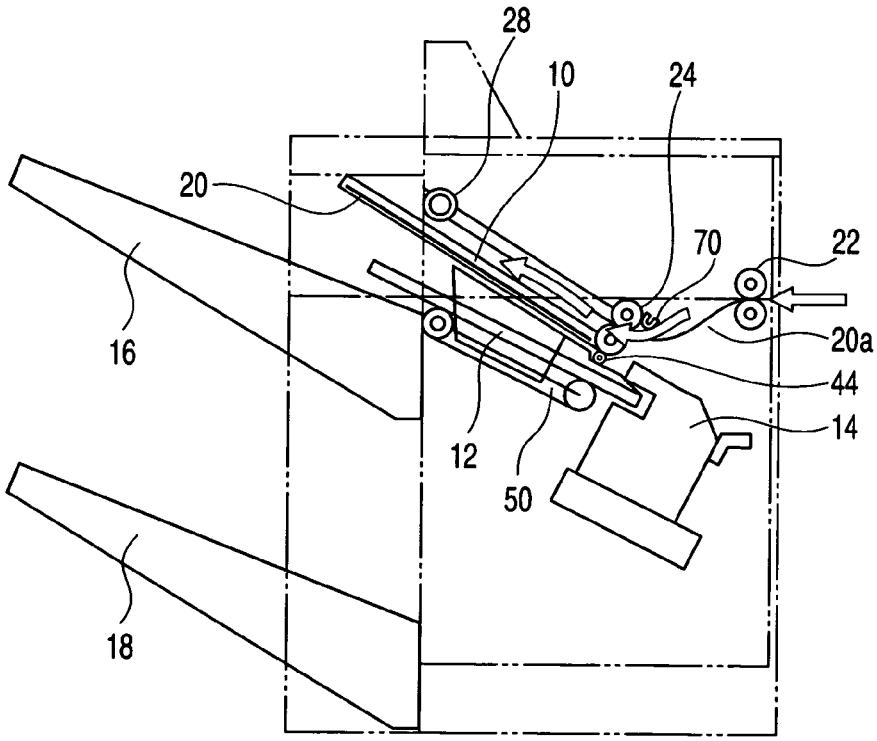
FIG. 9 is a view illustrating a flow of a second sheet of sheets between the paper feed roller and the standby roller in the post-process apparatus showing one embodiment of the invention.
Figure 10:
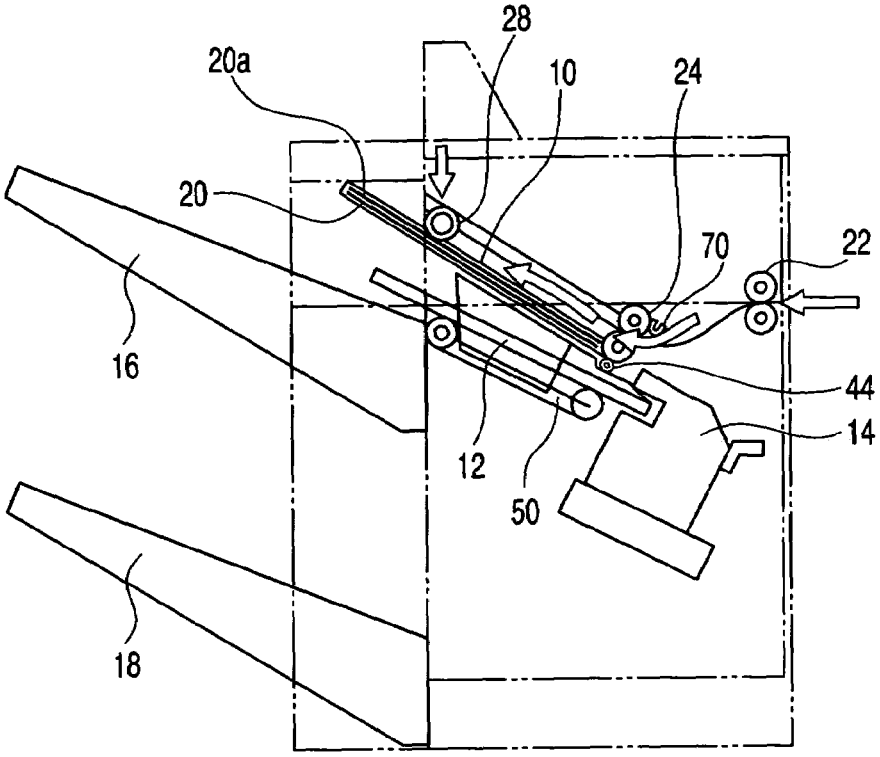
FIG. 10 is a view illustrating an operation of a waiting tray roller in the post-process apparatus showing one embodiment of the invention.

As shown in FIG. 6, the stapler 14 is positioned by a staple drive unit 49, and staple processing is controlled.

<Storage Tray>

As shown in FIG. 4, the staple processed bundles of sheets are sent to the storage tray 16 by the transport mechanism 50. Selection of the storage tray 16 or 18 is made by vertically moving the storage tray 16 or 18 by a storage tray drive unit 52.

In the case where sheets are directly ejected from the waiting tray 10, the storage tray is risen up to a location which corresponds to a sheet outlet of the waiting tray.

(Description of Operation)

Now, an operation of the post-process apparatus according to the present invention will be described with reference to FIGS. 7 to 18.

<Operation in Case Where Staple Processing is Carried Out>

As has been already described, staple processing on the processing tray is slow as compared with that on the image processing apparatus. Thus, when a sheet transported from the image processing apparatus is processed on the processing tray, a buffer unit is provided at the front stage thereof. Then, it is necessary to make a next sheet standby until not so as to be transported to the processing tray until the staple processing on the processing tray has completed. In this example, a description will be given with respect to a case in which two sheets (first and second sheets) are made standby on the waiting tray, and the third and subsequent sheets are not required to be made standby.

A first sheet from the image processing apparatus is transported to the waiting tray 10 via the inlet roller 22 and the paper feed roller 24. The sheet is retained by the left and right lower face support members 10*a* and 10*b* and the distal end retainer member which are set at a first position; the waiting tray roller 28 is lowered, and a sheet distal end is aligned (this alignment is made with the distal end 60 of the waiting tray 10 (upstream side)).

Figure 11:
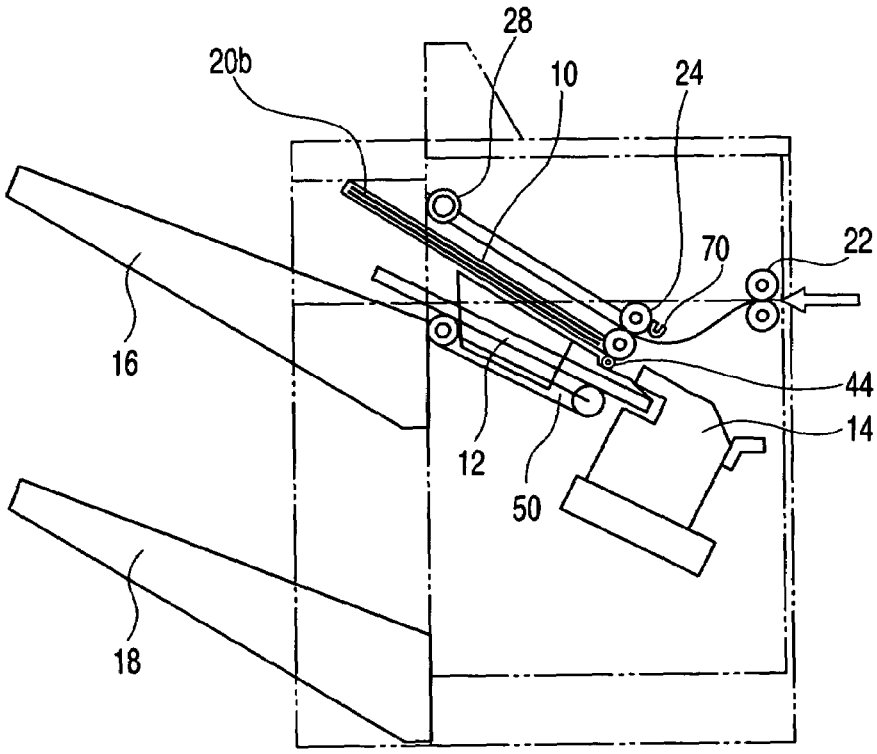
FIG. 11 is a view illustrating an operation of the waiting tray roller in the post-process apparatus showing one embodiment of the invention.
Figure 12:
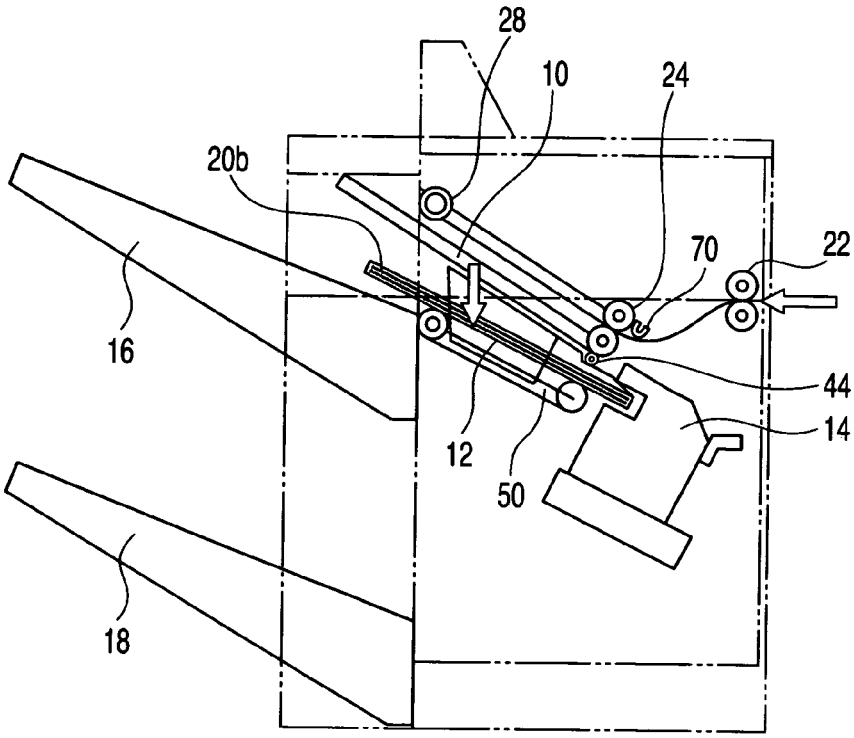
FIG. 12 is a view illustrating an operation of an active drop in the post-process apparatus showing one embodiment of the invention.

Next, the waiting tray roller 28 is risen, and is ready for accepting a second sheet 20*a*. When the second sheet 20*a* is sent to the waiting tray 10, the waiting tray roller 28 is lowered to align a location of the sheet with the distal end 60 of the waiting tray 10. Then, the waiting tray roller 28 is risen (FIG. 11). When the second sheet is transported to the waiting tray, the distal end portion of the sheet is sensed by the sheet sensor 70. Based on this sense signal, the first and second sheets are dropped onto the processing tray 12 altogether. That is, the left and right lower face support members 10*a* and 10*b* are opened to be located at the second position or third position so as to release support of both sides of the sheet.

Then, with respect to the third and subsequent sheets, it is possible to transport these sheets from the paper feed roller 24 directly to the waiting tray while the waiting tray is kept in a state in which the support of the sheets is released. However, in the present invention, the above sheets are dropped to the processing tray 12 via the waiting tray 10. With respect to this matter, a description will be given with reference to FIGS. 21 to 24.

Figure 21A:
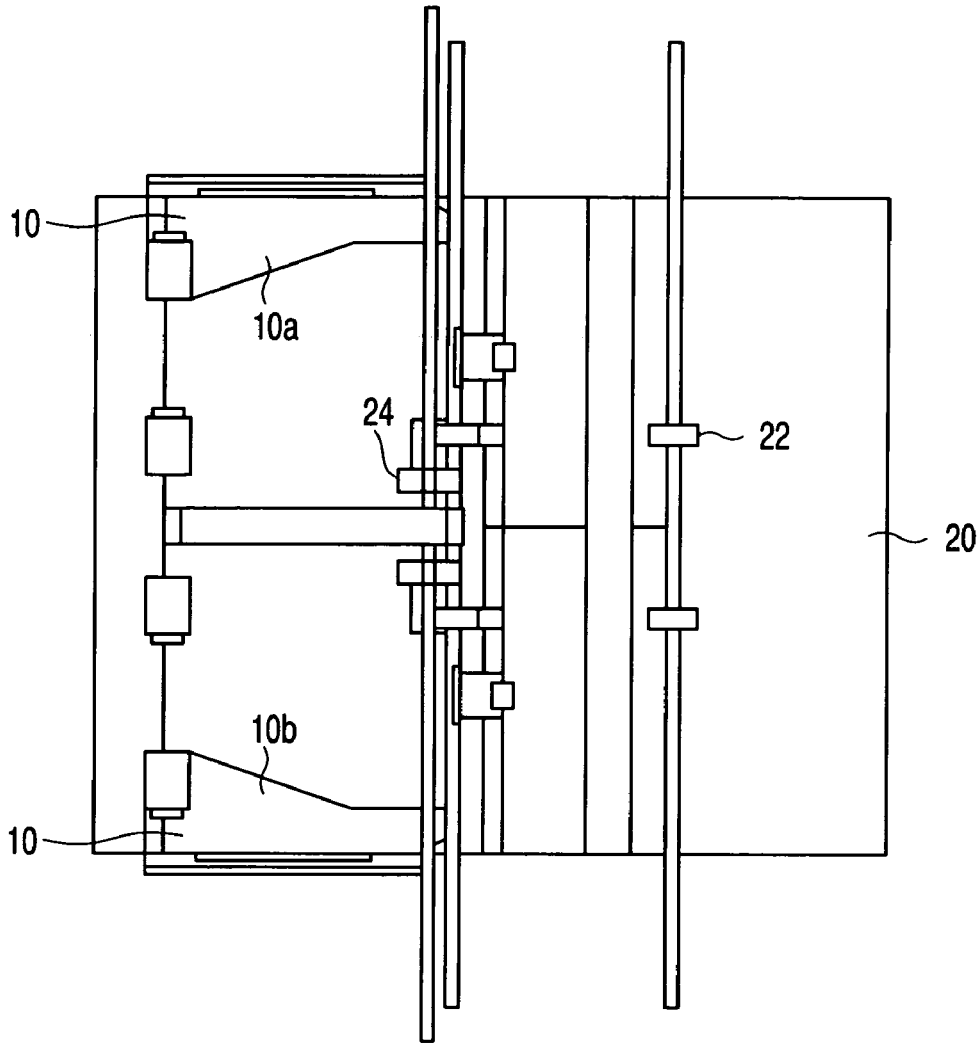
Figure 21B:
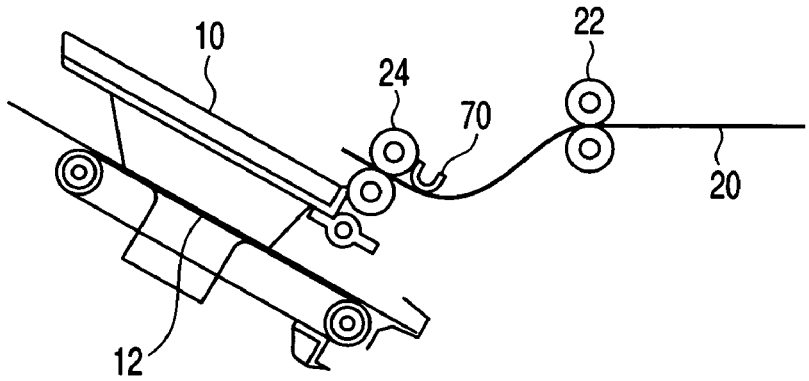
Figure 22A:
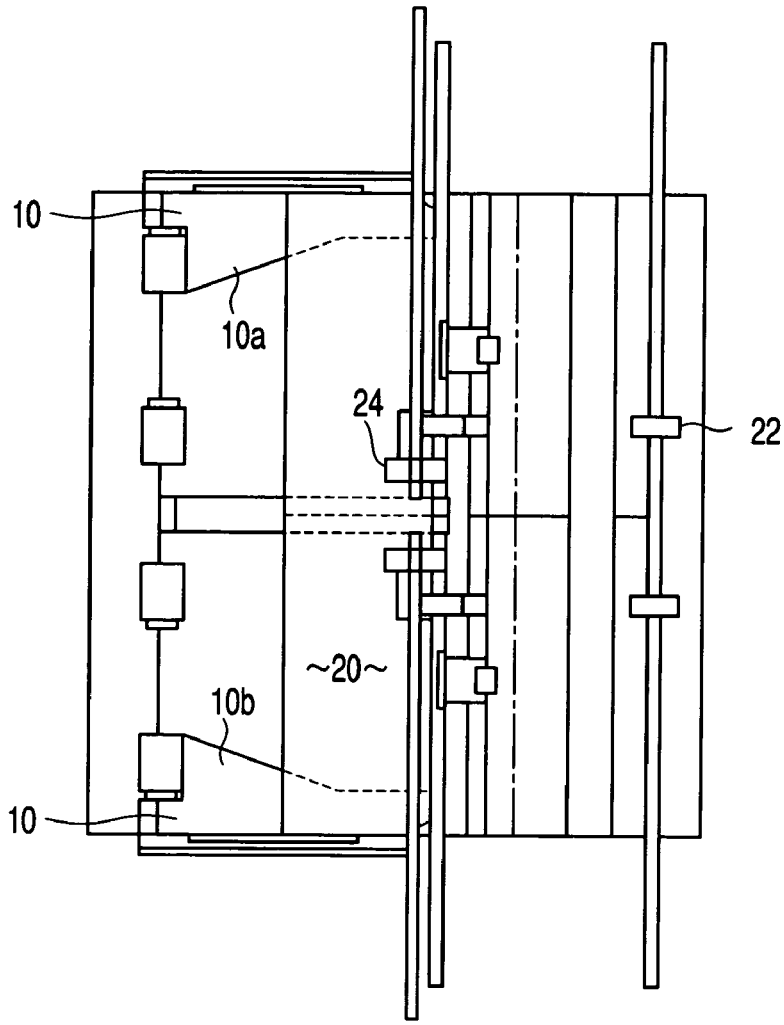
Figure 22B:
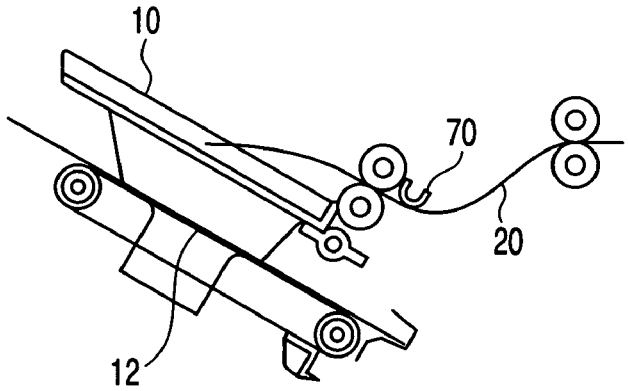
Figure 23A:
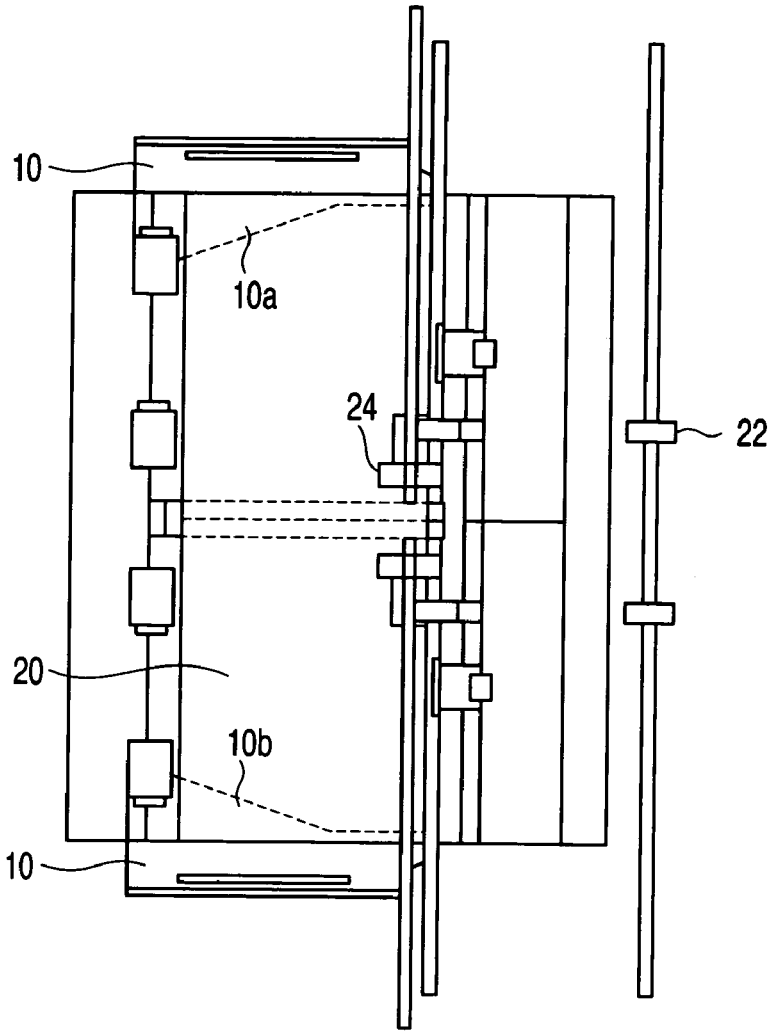
Figure 23B:
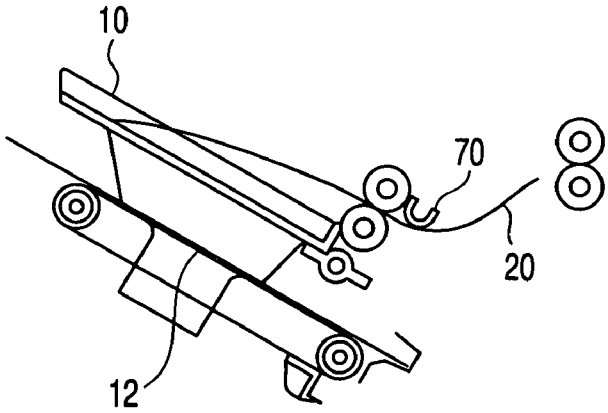
Figure 24A:
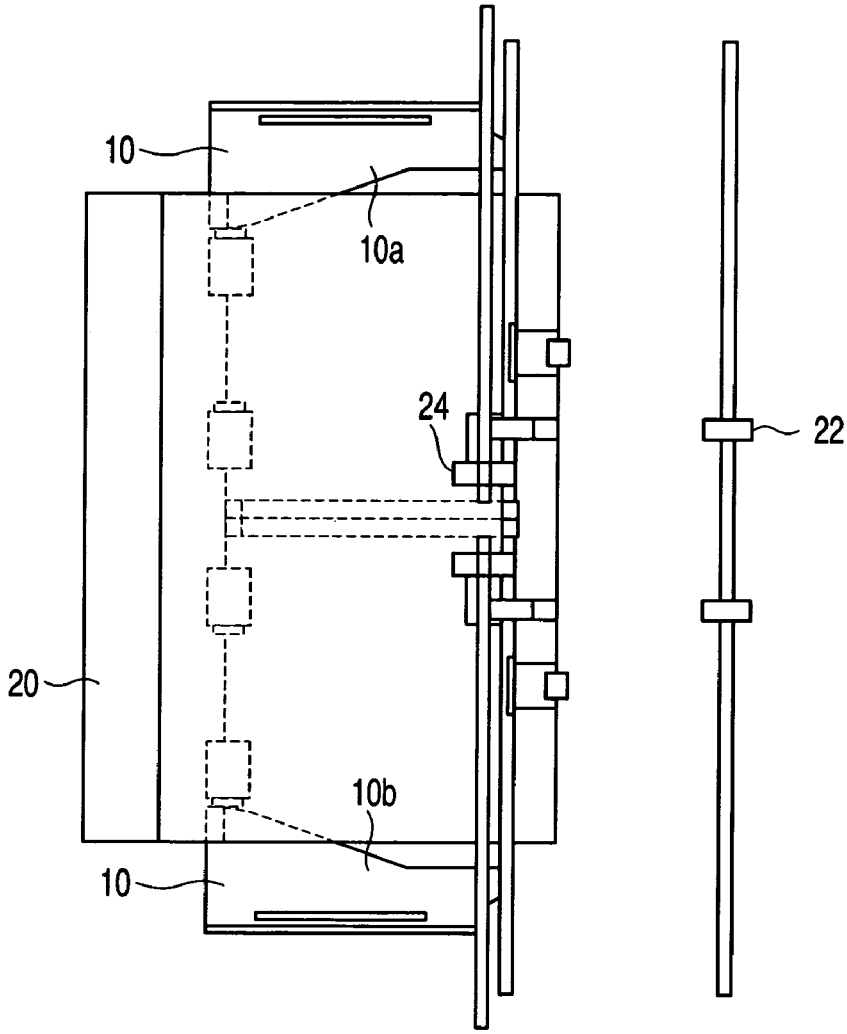
Figure 24B:
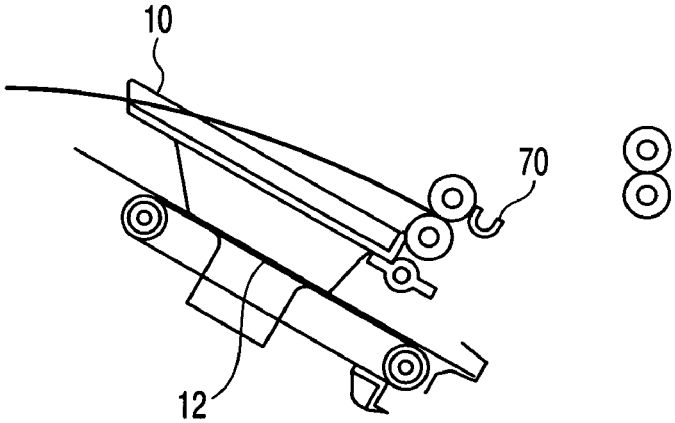

After the second sheet has been dropped on the processing tray, as shown in FIG. 21, the left and right lower face support members 10*a* and 10*b* return to the first position, and are kept in a state in which the third sheet can be supported. In this state, the third sheet is transported to the waiting tray 10 (FIG. 22). In a transport state, an opening operation (operation for widening the opening portion) of the left and right lower face support members 10*a* and 10*b* is started (FIG. 23). Then, when the sheet sensor 70 senses that the sheet distal end portion has been transported to the waiting tray 10, the waiting tray is released to the second position at this time point. At the second position, although the proximal end side (downstream side) of the left and right lower face support members 10*a* and 10*b* is retained, the distal end side (upstream side) thereof is released. Therefore, the sheet is reliably dropped from the distal end side to the processing tray. In this manner, the sheet is dropped on the processing tray without being retained on the waiting tray 10 in a waiting mode so that a processing speed can be increased. Moreover, on the processing tray 12, the sheet is dropped from the distal end side, so that the sheet can be stably dropped with good posture. Therefore, alignment processing of the sheet distal end on the processing tray 12 can be easily carried out. Moreover, the waiting tray 10 is allocated to be inclined lowly at the distal end side. This allocation helps the sheet being reliably dropped on the processing tray. In this case, the release speed and timing of the left and right lower face support members 10*a* and 10*b* are adjusted to their proper values based on the sheet length. Information concerning the sheet length is obtained from a control circuit of the image forming apparatus. Alternatively, the sheet sensing sensor is provided immediately after the inlet roller 22, and the distal end of the sheet is sensed, thereby making it possible to determine the release timing of the lower face support members 10*a* and 10*b*.

Figure 13:
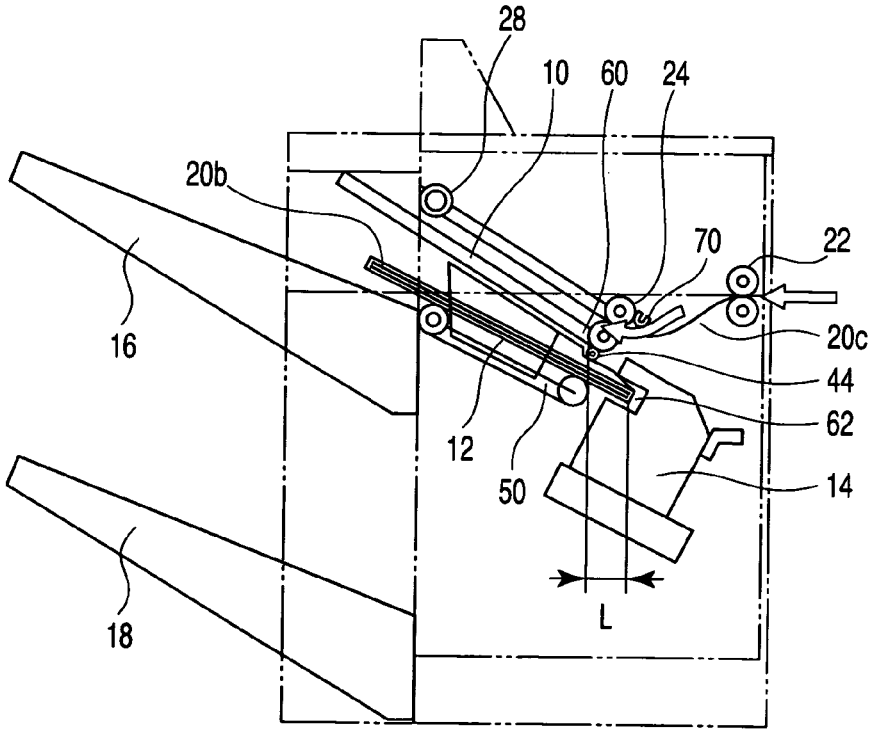
FIG. 13 is a view illustrating a flow of a third sheet of sheets in the post-process apparatus showing one embodiment of the invention.

Now, turning to FIG. 13, a state in which as second sheet has been held on the processing tray 12 will be described here. On the processing tray 12, a predetermined number of sheet bundles 21 are formed to be stacked on two bundles of sheets 20*b*. At this time, the longitudinal and transverse alignment mechanisms 38 and 47 function, and longitudinal and transverse sheet alignments are executed. At this time, as shown in FIG. 13, the distal end 60 of the waiting tray 10 and a distal end 62 (upstream side) of the processing tray 12 are spaced from each other in a transverse direction with a distance L so that the distal end 60 of the waiting tray 10 exists on the downstream side more than the distal end 62 of the processing tray 12. With such a construction, the bundles of sheets 20*b* are easily dropped from the waiting tray 10 to the processing tray 12, and an aligning operation by the longitudinal and transverse alignment mechanisms 38 and 47 can be easily made. As a result, an occurrence of jamming can be prevented.

The processing tray 12 is allocated to be obliquely inclined together with the waiting tray 10. Thus, the respective distal ends 60 and 62 are located at the lowest position, and the sheets 20 and the bundles of sheets 21 can be aligned with the distal ends 60 and 62 by its own weight of the sheets 20 and the bundles of sheets 21.

Figure 14:
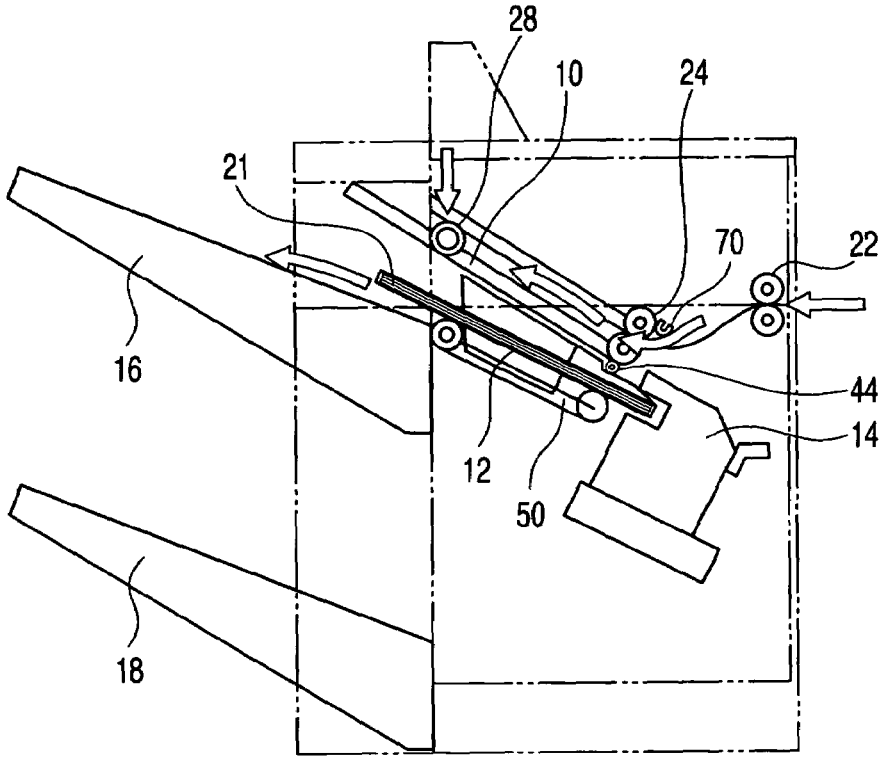
FIG. 14 is a view illustrating an operation of a stapler in the post-process apparatus showing one embodiment of the invention.
Figure 15:
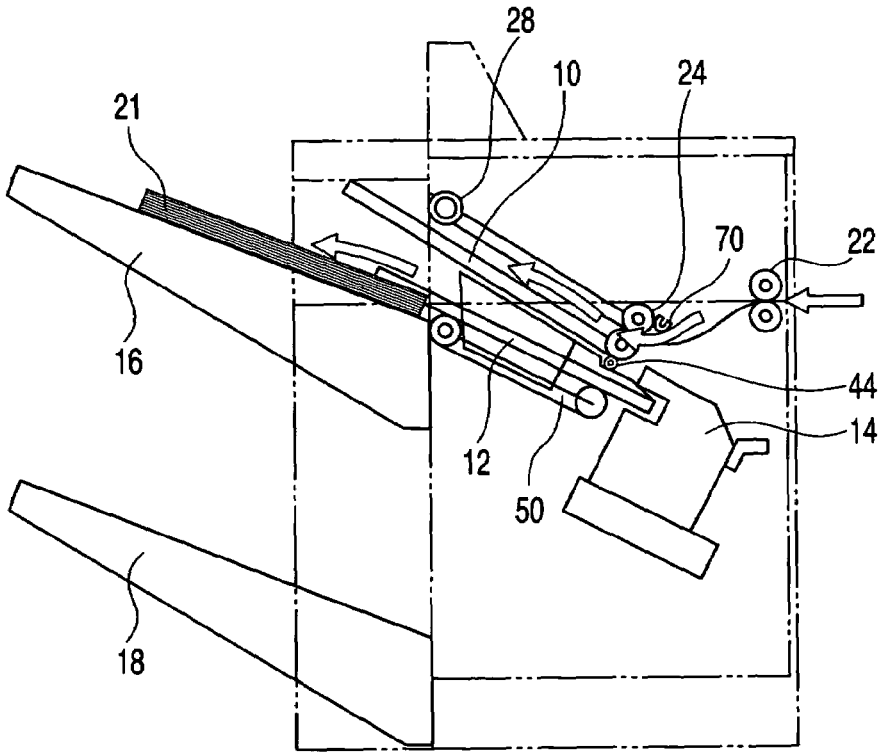
FIG. 15 is a view illustrating a flow of a bundle of sheets between a processing tray and a storage tray in the post-process apparatus showing one embodiment of the invention.

Next, as shown in FIG. 14, the bundles of sheets 21 are staple processed by the stapler 14. Then, as shown in FIG. 15, the bundles of sheets 20 are fed to the storage tray 16 by the transport mechanism 50, and post-process terminates.

<Operation in Case Where no Post-Process is Required>

Figure 16:
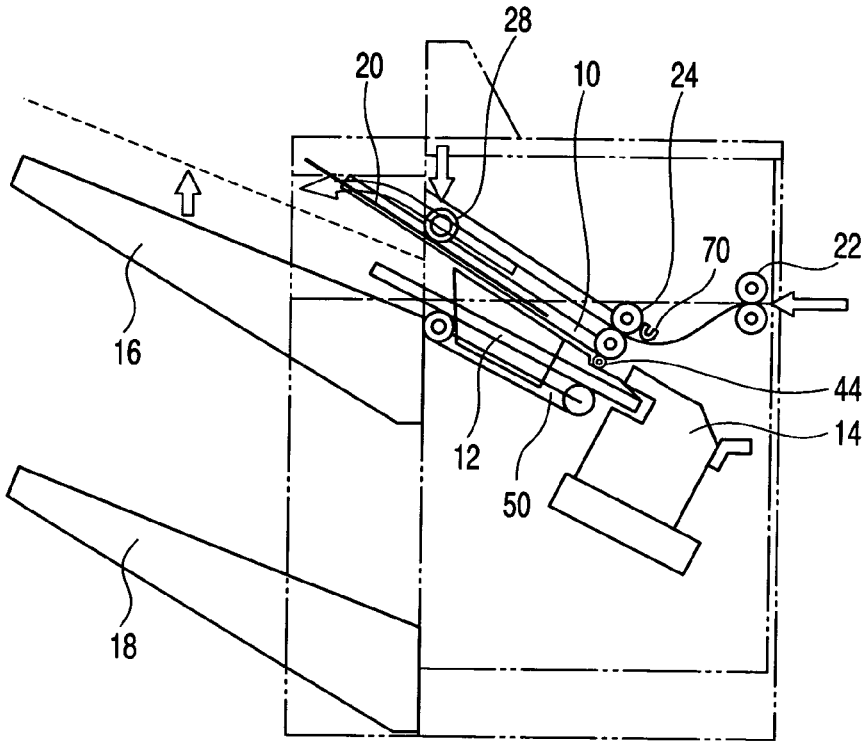
FIG. 16 is a view illustrating a flow of direct sheet ejection of a sheet from the waiting tray to the storage tray in the post-process apparatus showing one embodiment of the invention.
Figure 17:
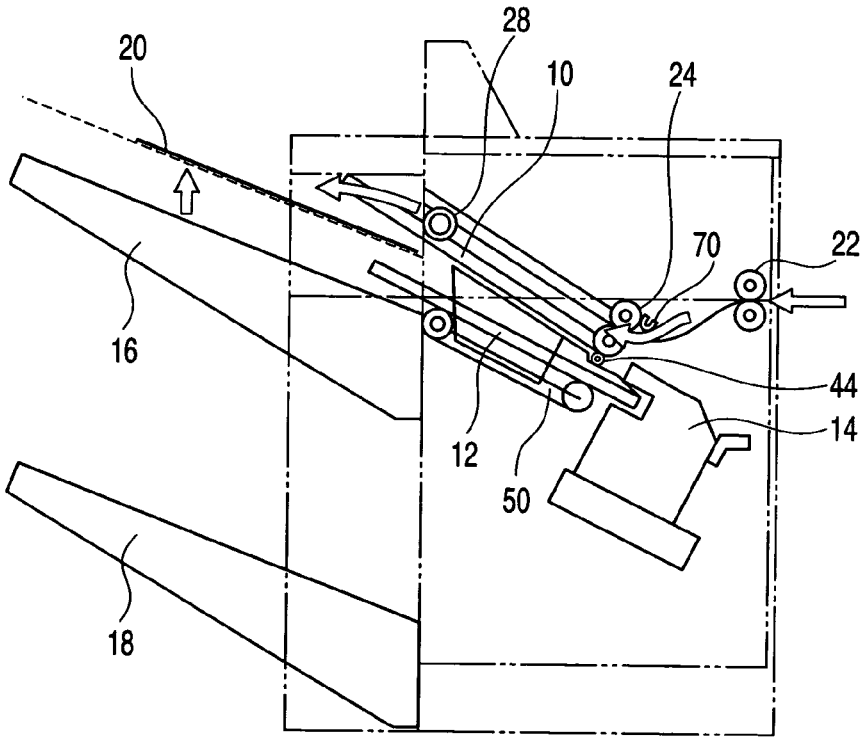
FIG. 17 is a view illustrating an operation of a position change of the storage tray in the post-process apparatus showing one embodiment of the invention.

In the case where no post-process (such as a case in which no staple processing is carried out or a case in which jamming occurs) is required, as shown in FIGS. 16 and 17, the sheets are ejected from the waiting tray 10 directly to the storage tray 16 without intervening the processing tray 12. As shown in FIG. 16, the sheets fed from the image processing apparatus are fed to the storage tray 16 via the paper feed roller 24 and the waiting tray 10. The waiting tray 28 is lowered to transport the sheets 20. The storage tray 16, as shown in FIG. 17, is slightly risen by the storage tray drive portion 52 to receive the sheets fed from the waiting tray 10.

Although embodiments of the present invention have been described above, the present invention is not limited to the embodiments. Constituent elements shown in the embodiments can be changed to other constituent elements as long as they have the same functions.

What is claimed is:

1. A sheet post-process apparatus, the apparatus comprising:

a waiting tray which temporarily retains a transported sheet in a waiting mode, and releases a retention to drop the sheet;

a processing tray which bundles sheets dropped from the waiting tray to carry out predetermined processing, and ejects the bundle of sheets; and a storage tray which holds the bundle of sheets processed and ejected on the processing tray, wherein the waiting tray comprises:

left and right lower face support members which support left and right lower faces in a sheet transport direction during the retention in the waiting mode, wherein the left and right lower face support members are positioned to support a proximal end side and a distal end side of the sheet in the waiting mode, and release a support of the left and right lower faces during release of the retention, a width of an opening portion formed between both of the members being widely formed at the distal end side compared with the proximal end side in a transport direction of the sheet transported to the waiting tray;

drive means for opening the left and right lower face support members to widen the width of the opening portion;

sensor means for sensing the sheet transported to the waiting tray; and control means operating in the waiting mode and a non-waiting mode, the control means drives the drive means based on a sense signal of the sensor means, and the control means controls the drive means so that both of the support members are opened to an extent such that the width of the opening portion is narrower than a sheet width at the proximal end side in the transport direction of the sheet and is wider than the sheet width at the distal end side thereof, wherein the left and right lower face support members are positioned to support only the proximal end side of the sheet in the non-waiting mode, so that the sheet is dropped from the sheet distal end to the processing tray without being retained in the waiting mode.

2. The sheet post-process apparatus according to claim 1, wherein the control means controls the drive means upon receipt of a signal indicating that the sheet to be transported to the waiting tray is a sheet which is not required to be retained in the waiting mode.

3. The sheet post-process apparatus according to claim 1, wherein the waiting tray is allocated to be proximal to an upper stage of the processing tray, the processing tray and the waiting tray are inclined, each with the proximal end side of the sheet located at a lower level, the processing tray and the waiting tray are shorter in length of a sheet transport direction thereof than a length of a standard sheet to be held, and a part of the proximal end side in the transport direction of the sheet held on the processing tray is held on the storage tray.

4. A waiting tray for use in a sheet post-process apparatus, for temporarily retaining a transported sheet in a waiting mode and releasing a support, making it possible to drop the sheet on a processing tray, the waiting tray comprising:

left and right lower face support members which support left and right lower faces in a sheet transport direction during a retention in the waiting mode, wherein the left and right lower face support members are positioned to support a proximal end side and a distal end side of the sheet in the waiting mode, and release the support of the left and right lower faces during release of the retention, a width of an opening portion formed between both of the members being widely formed at the distal end side compared with the proximal end side in a transport direction of the sheet transported to the waiting tray;

drive means for opening the left and right lower face support members to widen the width of the opening portion;

sensor means for sensing the sheet transported to the waiting tray; and control means operating in the waiting mode and a non-waiting mode, the control means drives the drive means based on a sense signal of the sensor means, and the control means controls the drive means so that both of the support members are opened to an extent such that the width of the opening portion is narrower than a sheet width at the proximal end side in the transport direction of the sheet and is wider than the sheet width at the distal end side thereof, wherein the left and right lower face support members are positioned to support only the proximal end side of the sheet in the non-waiting mode, so that the sheet is dropped from the sheet distal end to the processing tray without being retained in the waiting mode.

5. The waiting tray according to claim 4, wherein the left and right lower face support members are slidable in a widthwise direction of a sheet to be transported.

6. A sheet post-process apparatus, the apparatus comprising:

waiting means for temporarily retaining a transported sheet in a waiting mode, and releasing a retention to drop the sheet;

processing means for bundling sheets dropped from the waiting means to carry out predetermined processing, and ejecting the bundle of sheets; and storage means for holding the bundle of sheets processed and ejected on the processing means, wherein the waiting means comprises:

left and right lower face support means which support left and right lower faces in a sheet transport direction during the retention in the waiting mode, wherein the left and right lower face support means are positioned to support a proximal end side and a distal end side of the sheet in the waiting mode, and release a support of the left and right lower faces during release of the retention, a width of an opening portion formed between both of the means being widely formed at the distal end side compared with the proximal end side in a transport direction of the sheet transported to the waiting means;

drive means for opening the left and right lower face support means to widen the width of the opening portion;

sensor means for sensing the sheet transported to the waiting means; and control means operating in the waiting mode and a non-waiting mode, the control means drives the drive means based on a sense signal of the sensor means, and the control means controls the drive means so that both of the support means are opened to an extent such that the width of the opening portion is narrower than a sheet width at the proximal end side in the transport direction of the sheet and is wider than the sheet width at the distal end side thereof, wherein the left and right lower face support means are positioned to support only the proximal end side of the sheet in the non-waiting mode, so that the sheet is dropped from the sheet distal end to the processing means without being retained in the waiting mode.

7. The sheet post-process apparatus according to claim 1, further comprising a sheet-conveying mechanism which conveys the bundle of sheets from the processing tray to the storage tray.

8. The sheet post-process apparatus according to claim 6, further comprising conveying means for conveying the bundle of sheets from the processing means to the storage means.

9. The sheet post-process apparatus according to claim 1, wherein the waiting tray includes an alignment mechanism to align the sheet on the waiting tray.

10. The waiting tray according to claim 4, further comprising an alignment mechanism to align the sheet on the waiting tray.

11. The sheet post-process apparatus according to claim 6, wherein the waiting means includes an alignment means for aligning the sheet on the waiting means.

12. The sheet post-process apparatus according to claim 1, wherein the processing tray includes an alignment mechanism that performs longitudinal and transverse alignments on the bundle of sheets.

13. The sheet post-process apparatus according to claim 6, wherein the processing means includes an alignment means for performing longitudinal and transverse alignments on the bundle of sheets.

14. The sheet post-process apparatus according to claim 1, further comprising a post-process mechanism which carries out the predetermined processing on the bundle of sheets on the processing tray.

15. The sheet post-process apparatus according to claim 6, further comprising a post-process means for carrying out the predetermined processing on the bundle of sheets on the processing means.

16. The sheet post-process apparatus according to claim 1, wherein the bundle of sheets lies across the processing tray and the storage tray before the predetermined processing is carried out.

17. The sheet post-process apparatus according to claim 6, wherein the bundle of sheets lies across the processing means and the storage means before the predetermined processing is carried out.

18. The sheet post-process apparatus according to claim 1, wherein the left and right lower face support members each includes a flat face at one end and a curved face at another end.

19. The waiting tray according to claim 4, wherein the left and right lower face support members each includes a flat face at one end and a curved face at another end.

20. The sheet post-process apparatus according to claim 6, wherein the left and right lower face support means each includes a flat face at one end and a curved face at another end.

* * * * *